US008933860B2

(12) United States Patent
Schlie et al.

(10) Patent No.: US 8,933,860 B2
(45) Date of Patent: Jan. 13, 2015

(54) ACTIVE COOLING OF HIGH SPEED SEEKER MISSILE DOMES AND RADOMES

(71) Applicants: Integral Laser Solutions, LLC., Albuquerque, NM (US); The Curators of the University of Missouri, Columbia, MO (US)

(72) Inventors: LaVerne Arthur Schlie, Albuquerque, NM (US); Hongbin Ma, Columbia, MO (US)

(73) Assignees: Integral Laser Solutions, Inc., Albequerque, NM (US); The Curators of the University of Missouri, Columbia, MI (US)

( * ) Notice: Subject to any disclaimer, the term of this patent is extended or adjusted under 35 U.S.C. 154(b) by 0 days.

(21) Appl. No.: 13/916,271

(22) Filed: Jun. 12, 2013

(65) Prior Publication Data

US 2014/0190666 A1 Jul. 10, 2014

Related U.S. Application Data

(60) Provisional application No. 61/658,681, filed on Jun. 12, 2012.

(51) Int. Cl.
*H01Q 1/42* (2006.01)
*H01Q 1/02* (2006.01)
(Continued)

(52) U.S. Cl.
CPC ..... *F41G 11/00* (2013.01); *F28D 15/0266* (2013.01)
USPC ..... 343/872; 343/705; 343/708; 361/689; 361/699; 361/700; 165/104.33; 165/104.29; 165/104.14; 165/104.22; 165/41; 244/117 A; 244/171.8; 244/3.15; 244/3.16

(58) Field of Classification Search
USPC ..... 165/41, 104.14, 104.22, 104.29, 165/104.33; 343/872, 705, 708, 704; 244/171.8, 117 A, 3.15, 3.16; 361/689, 361/699, 700
See application file for complete search history.

(56) References Cited

U.S. PATENT DOCUMENTS 2,755,216 A * 7/1956 Lemons ..... 343/704
3,080,816 A * 3/1963 Levine ..... 244/117 A
(Continued)

FOREIGN PATENT DOCUMENTS

DE 4343125 A1 * 6/1995
DE 100 38 006 A1 2/2002
(Continued)

OTHER PUBLICATIONS

"Ceramic Missile Radomes", http://www.ceradyne-thermo.com/products/radomes.aspx, Sep. 28, 2008.
(Continued)

*Primary Examiner* — John Ford
(74) *Attorney, Agent, or Firm* — Jeffrey D. Myers; Peacock Myers, P.C.

(57) ABSTRACT

A thermal management system and method for active cooling of high speed seeker missile domes or radomes comprising bonding to an IR dome or RF radome a heat pipe system having effective thermal conductivity of 10-20,000 W/m*K and comprising one or more mechanically controlled oscillating heat pipes, employing supporting integrating structure including a surface bonded to the IR dome or RF radome that matches the coefficient of thermal expansion the dome or radome material and that of said one or more mechanically controlled oscillating heat pipes, and operating the heat pipe system to cool the IR dome or RF radome while the missile is in flight.

20 Claims, 30 Drawing Sheets

Optical diagram of a typical passive non-imaging seeker.

(51) Int. Cl.

| | |
|---|---|
| ***H01Q 1/00*** | (2006.01) |
| ***F41G 11/00*** | (2006.01) |
| ***F28D 15/02*** | (2006.01) |

(56) References Cited

U.S. PATENT DOCUMENTS

| | | | | |
|---|---|---|---|---|
| 3,081,051 | A * | 3/1963 | Robinson, Jr. | 343/872 |
| 3,128,965 | A * | 4/1964 | Ziemer | 343/705 |
| 3,396,396 | A * | 8/1968 | Charlton et al. | 343/872 |
| 4,009,848 | A | 3/1977 | Albert et al. | |
| 4,057,104 | A * | 11/1977 | Altoz | 165/104.33 |
| 4,470,450 | A | 9/1984 | Bizzell et al. | |
| 4,520,364 | A * | 5/1985 | Perry | 343/872 |
| 4,850,275 | A | 7/1989 | Utreja et al. | |
| 4,921,041 | A | 5/1990 | Akachi | |
| 4,949,920 | A | 8/1990 | Schindel et al. | |
| 5,219,020 | A | 6/1993 | Akachi | |
| 5,335,237 | A | 8/1994 | Zapata | |
| 5,340,058 | A | 8/1994 | Holl et al. | |
| 5,372,333 | A * | 12/1994 | Uwira et al. | 244/117 A |
| 5,457,471 | A | 10/1995 | Epperson, Jr. | |
| 5,553,088 | A | 9/1996 | Brauch et al. | |
| 5,911,272 | A | 6/1999 | Cornog et al. | |
| 6,158,502 | A | 12/2000 | Thomas | |
| 6,167,948 | B1 | 1/2001 | Thomas | |
| 6,241,184 | B1 * | 6/2001 | Sunne et al. | 343/872 |
| 6,347,109 | B1 | 2/2002 | Beach et al. | |
| 6,438,152 | B2 | 8/2002 | Contag et al. | |
| 6,577,666 | B2 | 6/2003 | Erhard et al. | |
| 6,600,763 | B2 | 7/2003 | Ludewigt | |
| 6,745,830 | B2 | 6/2004 | Dinh | |
| 6,804,274 | B2 | 10/2004 | Huonker et al. | |
| 6,891,874 | B2 | 5/2005 | Erhard et al. | |
| 6,963,592 | B2 | 11/2005 | Huonker et al. | |
| 7,003,011 | B2 | 2/2006 | Kafka et al. | |
| 7,200,160 | B2 | 4/2007 | Ludewigt | |
| 7,200,161 | B2 | 4/2007 | Vetrovec | |
| 8,045,329 | B2 * | 10/2011 | Chen et al. | 343/872 |
| 8,213,471 | B2 * | 7/2012 | Schlie et al. | 372/35 |
| 8,509,273 | B2 * | 8/2013 | Schlie et al. | 372/35 |
| 8,698,691 | B2 * | 4/2014 | Chen et al. | 343/872 |
| 2001/0013565 | A1 | 8/2001 | Davidovitch | |
| 2005/0057831 | A1 | 3/2005 | Marshall | |
| 2005/0284612 | A1 | 12/2005 | Machiroutu | |
| 2007/0238219 | A1 | 10/2007 | Bennett et al. | |
| 2008/0198882 | A1 | 8/2008 | Clar et al. | |
| 2009/0126922 | A1 | 5/2009 | Vetrovec | |
| 2009/0161702 | A1 | 6/2009 | Takeshita et al. | |

FOREIGN PATENT DOCUMENTS

| | | | |
|---|---|---|---|
| EP | 0 904 615 | | 9/2001 |
| FR | 2631745 | A * | 11/1989 |
| FR | 2922050 | A1 * | 4/2009 |
| JP | 05-052498 | | 3/1993 |
| WO | 2011/091381 | A2 | 7/2011 |

OTHER PUBLICATIONS

"Piezoelectric Fluid Pumps", http://www.kineticceramics.com/piez_fluid.html, Dec. 2, 2011.

"Refractive Microlens Arrays", http://www.suss-mirooptics.com, 2010.

Backhaus, S. et al., "A thermoacousitc Stirling heat engine", Nature, vol. 399, Macmillan Magazines Ltd., May 27, 1999, 335-338.

Bang, In C. et al., "Boiling heat transfer performance and phenomena of Al2O3-water nano-fluids from a plain surface in a pool", International Journal of Heat and Mass Transfer, vol. 48, Elsevier Ltd., 2005, 2407-2419.

Borgmeyer, B. et al., "Experimental Investigation of Oscillating Motions in a Flat Plate Pulsating Heat Pipe", Journal of Thermophysics and Heat Transfer, vol. 21, No. 2, Apr.-Jun. 2007, 405-409.

Brown, David C. , "Nonlinear Thermal Distortion in YAG Rod Amplifiers", IEEE Journal of Quantum Electronics, vol. 34, No. 12, IEEE, Dec. 1998, 2283-2392.

Cai, Qingjun et al., "An Infestigation of Temperature Characteristics of Pulsating Heat Pipe", Proceedings of IMECE2005, 2005 ASME International Mechanical Enginerring Congress and Exposition, Orlando, FL., Nov. 5-11, 2005, 1-6.

Carslaw, H.S. et al., "Conduction of Heat in Solids", Second Edition, Oxford University Press, Oxford, United Kingdom, 1986, 29-35.

Choi, S. U. et al., "Anomalous thermal conductivity enhancement in nanotube suspensions", Applied Physics Letters, vol. 79, No. 14, American Institute of Physics, Oct. 1, 2001, 2252-2254.

Choi, Stephen U. et al., "Enhancing Thermal Conductivity of Fluids with Nanoparticles", Developments and Applications of Non-Newtonian Flows, ed. D.A. Siginer and H.P. Wang, The American Society of Mechanical Engineers, New York, FED-vol. 231/MD-vol. 66, 1995, 99-105.

Contag, K. et al., "Theoretical modelling and experimental investigations of the diode-pumped thin-disk Yb: YAG laser", Quantum Electroni, vol. 29, 1999, 697-703.

Cousins, Ananada K. , "Temperature and Thermal Stress Scaling in Finite-Length End-Pumped Laser Rods", IEEE Journal of Quantum Electronics, vol. 28, No. 4, Apr. 1992, 1067-1069.

Das, S. P. et al., "Thermally induced two-phase oscillating flow inside a capillary tube", International Journal of Heat and Mass Transfer, vol. 53, 2010, 3905-3913.

Das, Sarit K. et al., "Heat Transfer in Nanofluids—A Review", Heat Transfer Engineering, vol. 27, No. 10, 2006, 3-19.

Demsky, S. M. et al., "Thin Film Evaporation on a Curved Surface", Microscale Thermophysical Engineering, vol. 8, Taylor & Francis Inc., 2004, 285-299.

Eastman, J. A. et al., "Anomalously increased effective thermal conductivities of ethylene glycol-based nanofluds containing copper nanoparticles", Applied Physics Letters, vol. 78, No. 4, Feb. 5, 2001, 710-720.

Feeler, Ryan et al., "Next-Generation Microchannel Coolers", High-Power Diode Laser Technology and Applications VI, Proc. of SPIE, vol. 6876, 2008, 687608-1-8.

Giesen, A. et al., "Scalable Concept for Diode-Pumped High-Power Solid-State Lasers", Appl. Phys. B, vol. 58, Springer-Verlag, 1994, 365-372.

Giesen, Adolf et al., "Fifteen Years of Work on Thin-Disk Lasers: Results and Scaling Laws", IEEE Journal of Selected Topics in Quantum Electronics, vol. 13, No. 3, May/Jun. 2007, 598-609.

Gosz, M. R. et al., "Finite Element Method, Applications in Solids, Structures and Heat Transfer", Francis & Faylor, 2006, 290-295.

Han, Xu et al., "Investigations on the heat transport capability of a cryogenic oscillating heat pipe and its application in achieving ultra-fast cooling rates for cell vitrification cryopreservation", Cryobiology, vol. 56, Elsevier Inc., 2008, 195-203.

Hanlon, M. A. et al., "Evaporation Heat Transfer in Sintered Porous Media", Transactions of the ASME, vol. 125, ASME, Aug. 2003, 644-652.

Heinen, B. et al., "106 W continuous-wave output power from vertical-external-cavity surface-emitting laser", Electronics Letters, vol. 48, No. 9, Apr. 26, 2012, 515-516.

Hellstrom, J. E. et al., "Efficient Ybh:KGW lasers end-pumped by high-power diode bars", Appl. Phys. B, vol. 83, Jun. 27, 2006, 235-236.

Innocenzi, M. E. et al., "Thermal modeling of continuous-wave end-pumped solid-state lasers", Appl. Phys. Lett., vol. 56, No. 19, American Institute of Physics, May 7, 1990, 1831-1833.

Karunanithi, R. et al., "Development of Cryogenic Loop Heat Pipe", Transactions of the Cryogenic Engineering Conference, vol. 53, American Institute of Physics, 2008, 393-400.

Kaviany, M. , "Chapter 12, Phase Change", Principles of Heat Transfer in Porous Media, Springer, N.Y., 1995.

Kaviany, M. , "Performance of a Heat Exchanger Based on Enhanced Heat Diffusion in Fluids by Oscillation: Analysis", Journal of Heat Transfer, vol. 112, ASME, Feb. 1990, 49-55.

Kaviany, M. et al., "Performance of a Heat Exchanger Based on Enhanced Heat Diffusion in Fluids by Oscillation: Experiment", ASME Journal of Heat Transfer, vol. 112, Feb. 1990, 56-63.

(56) References Cited

OTHER PUBLICATIONS

Khandekar, Sameer et al., "An insight into thermo-hydrodynamic coupling in closed loop pulsating heat pipes", International Journal of Thermal Sciences, vol. 43, 2004, 13-20.
Khandekar, Sameer et al., "An insight into thermo-hydrodynamic coupling in closed loop pulsating heat pipes", International Journal of Thermal Sciences, vol. 43, Elsevier SAS, 2004, 13-20.
Khandekar, Sameer et al., "Thermal Performance Modeling of pulsating Heat Pipes by Artificial Neural Network", Proceedings of 12th International Heat Pipe Conference, Moscow, Russia, 2002, 215-219.
Klein, Claude A. , "Infrared Missile Domes: Heat Flux and Thermal Shock", SPIE Proceedings, vol. 1739, 1992, 230-253.
Klein, Claude A. et al., "Thermal Shock Resistance of Convectively Heated Infrared Windows and Domes", SPIE Proceedings, vol. 3060, 1997, 115-129.
Koechner, W. , Solid-State Laser Engineering, 6th Revision, Springer Series in Optical Sciences, New York, NY, 2006, 426-431; 437-439.
Koechner, W. , "Solid-State Laser Engineering", 2nd Edition, Springer-Verlag, New York, 1988, 350-353.
Kohler, Bernd et al., "11 kW direct diode laser system with homogenized 55 x 20 mm2 Top-Hat intensity distribution", Proc. SPIE, vol. 6456, Feb. 7, 2007, 645600-1-12.
Kouznetsov, Dmitrii et al., "Surface loss limit of the power scaling of a thin-disk laser", J. Opt. Soc. Am. B, vol. 23, No. 6, Optical Society of America, Jun. 2006, 1074-1082.
Kurzweg, U. H. , "Enhanced Heat Conduction in Fluids Subjected to Sinusoidal Oscillations", Journal of Heat Transfer, vol. 107, ASME, May 1985, 459-462.
Kurzweg, U. H. et al., "Heat transfer by high-frequency oscillations: A new hydrodynamic technique for achieving large effective thermal conductivities", Phys. Fluids, vol. 27, No. 11, Nov. 1984, 2624-2627.
Lee, Dong G. et al., "Piezoelectric Pump with Innovative Non-Mechanical Active Valves", http://www.docstoc.com/docs/68836682/Piezoelectric-Pump-with-Innovative-Non-Mechanical-Active-Valves, 2004.
Liang, S. B. et al., "Thermoacoustic power effect on the refrigeration performance of thermal seperators", Cryogenics, vol. 43, Elsevier Ltd., 2003, 493-500.
Liao, Yan et al., "Pressure tuning of thermal lensing for high-power scaling", Optics Letters, vol. 24, No. 19, Oct. 1, 1999, 1343-1345.
Liter, Scott G. et al., "Pool-boiling CHF enhancement by modulated porous-layer coating: theory and experiment", International Journal of Heat and Mass Transfer, vol. 44, Elsevier Science Ltd., 2001, 4287-4311.
Lobad, Ahmed et al., "Characterization of a Multikilowatt Yb:YAG Ceramic Thin-Disk Laser", J. of Directed Energy, Mar. 2011, 1.
Ma, H. B. et al., "An Experimental Investigation of Heat Transport Capability in a Nanofluid Oscillating Heat Pipe", Journal of Heat Transfer, vol. 128, ASME, Nov. 2006, 1213-1216.
Ma, H. B. et al., "An investigation of oscialltting motions in a miniature pulsating heat pipe", Microfluid Nanofluid, vol. 2, 2006, 171-179.
Ma, H. B. et al., "Effect of nanofluid on the heat transport capability in an oscillating heat pipe", Applied Physics Letters, vol. 88, American Institute of Physics, 2006, 143116-1-3.
Ma, H. B. et al., "Fluid flow and transfer in the evaporating thin film region", Microfluid Nanofluid, vol. 4, Springer-Verlag, 2008, 237-243.
Ma, H. B. et al., "Heat Tranpsort Capability in a Pulsating Heat Pipe", Proceedings of the 8th AIAA/ASME Joint Thermophysical and Heat Transfer Conference, St. Louis, MO., Jun. 24-27, 2002, 1-7.
Ma, H. B. et al., "Heat Transport Capability in an Oscillating Heat Pipe", Journal of Heat Transfer, vol. 130, ASME, Aug. 2008, 081501-1-7.
Ma, H. B. et al., "Temperature Variation and Heat Transfer in Triangular Grooves with an Evaporating Film", Journal of Thermophysics and Heat Transfer, vol. 11, No. 1, Jan.-Mar. 1997, 90-97.
MacKenzie, Jacob I. , "Dielectric Solid-State Planar Waveguide Lasers: A Review", vol. 13, No. 3, May-Jun. 2007, 626-637.
Nikolayev, V. S. , "Modeling of pulsating heat pip (PHP)", http://www.pmmh/espci.fr/~nvikol/PHP.html, Sep. 16, 2011.
Nye, J. F. , "Chapter V. The Stress Tensor", Physical Properties of Crystals, Oxford Science Publications, New York, N.Y., 1993.
Park, K. et al., "Nanofluid Effect on Heat Transport Capability in a Well-Balanced Oscialltting Heat Pipe", Journal of Thermophysics and Heat Transfer, vol. 21, No. 2, Apr.-Jun. 2007, 443-445.
Paunescu, G. et al., "100-fs diode-pumped Yb:KGW mode-locked laser", Appl. Phys. B, vol. 79, 2004, 555-558.
Peters, Rigo et al., "Broadly tunable high-power Yb:Lu203 thin disk laser with 80% slope efficiency", Optics Express, vol. 15, No. 11, May 28, 2007, 7075-7082.
Qu, W. et al., "Theoretical analysis of startup of a pulsating heat pipe", International Journal of Heat and Mass Transfer, vol. 50, Elsevier Ltd., 2007, 2309-2316.
Qu, Wei et al., "Experimental Investigation on Flow and Heat Transfer of a Pulsating Heat Pipe", Heat Pipe Science Technology Application, Proceedings of the 12th International Heat Pipe Conference, Moscow, Russia, May 19-24, 2002, 226-231.
Rogalski, A. , "History of infrared detectors", Opto-Electronics Review, vol. 20, No. 3, Springer, 2012, 279-308.
Rogalski, A. et al., "Infrared devices and techniques", Opto-Electronics Review, vol. 10, No. 2, 2002, 111-136.
Seger, Kai et al., "Tunable Yb:KYW laser using a transversely chirped volume Bragg grating", Optics Express, vol. 17, No. 4, Feb. 16, 2009, 2341-2347.
Shafer, D. , "Gaussian to flat-top intensity distributing lens", Optics & Laser Technology, vol. 14, Issue 3, Jun. 1982, 159-160.
Stewen, Christian et al., "A 1-kW CW Thin Disc Layer", IEEE Journal of Selected Topics in Quantum Elecronics, vol. 6, No. 4, Jul./Aug. 2000, 650-657.
Sueda, K. et al., "High-efficiency laser-diodes-pumped microthickness Yb:Y3A15O12", Applied Physics Letters, American Institute of Physics, 2005, 151110-1-3.
Swift, K. M. et al., "Dispersion of gases in atomic iodine lasers at 1.315 um", Applied Optics, vol. 27, No. 21, Nov. 1, 1988, 4377-4384.
Thome, J. R. , "Chapter 6, Mechanisms of Enhanced Nucleate Pool Boiling", Enhanced Boiling Heat Transfer, Hemisphere Publishing Corporation, New York, 1990, 91-150.
Thompson, S. M. et al., "Effect of Localized Heating on Three-Dimensional Flat-Plate Oscillating Heat Pipe", Advances in Mechanical Engineering, vol. 2010, Hindawi Publishing Corporation, 2010, 1-10.
Thompson, S. M. et al., "Experimental Investigation of Miniature Three-Dimensional Flat-Plate Oscillating Heat Pipe", Journal of Heat Transfer, vol. 131, ASME, Apr. 2009, 043210-1-9.
Timoshenko, S. P. et al., "Theory of Elasticity", 3rd Edition, McGraw Hill, 1970, 440-443.
Traub, Martin et al., "Homogenization of high power diode laser beams for pumping and direct applications", Proc. SPIE, vol. 6104, Feb. 2006, 61040Q1-Q10.
Webb, R. L. , Principles of Enhanced Heat Transfer, John Wiley & Sons, Inc., New York, 1994, 330-331.
Wilson, C. et al., "Visual Observation of Oscillating Heat Pipes Using Neutron Radiography", Journal of Thermophysics and Heat Transfer, vol. 22, No. 3, Jul.-Sep. 2008, 366-372.
Womac, D. J. et al., "Correlating Equations for Impingement Cooling of Small Heat Sources with Single Circular Liquid Jets", Transactions of the ASME, vol. 115, Feb. 1993, 106-115.
Wynne, Rosalind et al., "Thermal coefficients of the expansion and refractive index in YAG", Applied Optics, vol. 38, No. 15, May 20, 1999, 3282-3284.
Xuan, Yimin et al., "Investigation on Convective Heat Transfer and Flow Features of Nanofluids", Journal of Heat Transfer, vol. 125, ASME, Feb. 2003, 151-155.
Yoshida, Hidetsugu et al., "Heavy fluorocarbon liquids for a phase-conjugated stimulated Brillouin scattering mirror", Applied Optics, vol. 36, No. 15, Jun. 1, 1997, 3739-3744.
Zhang, Yuwen et al., "Heat transfer in a pulsating heat pipe with open end", International Journal of Heat and Mass Transfer, vol. 45, 2002, 755-764.

(56) References Cited

OTHER PUBLICATIONS

Zhang, Yuwen et al., "Nonequilibrium heat conduction in a nanofluid layer with periodic heat flux", International Journal of Heat and Mass Transfer, vol. 51, Elsevier Ltd., 2008, 4862-4874.
Zhang, Yuwen et al., "Oscillatory Flow in Pulsating Heat Pipes with Arbitrary Numbers of Turns", Journal of Thermophysics and Heat Transfer, vol. 17, No. 3, Jul.-Sep. 2003, 340.
Zhenhai, Jiang et al., "Thermal-structure analysis of supersonic dome based on three materials", International Conference on Electric Information and Control Engineering (ICEICE), http://ieeexplore.ieee.org/xpl/freeabs_all.jsp?arnumber=5777830, 2011, 1868-1871.
Ziming, Wan , "The Calculating Models of Cooling IR Window and Window Background Radiation", SPIE Proceedings, vol. 3375, 1998, 195-202.

* cited by examiner

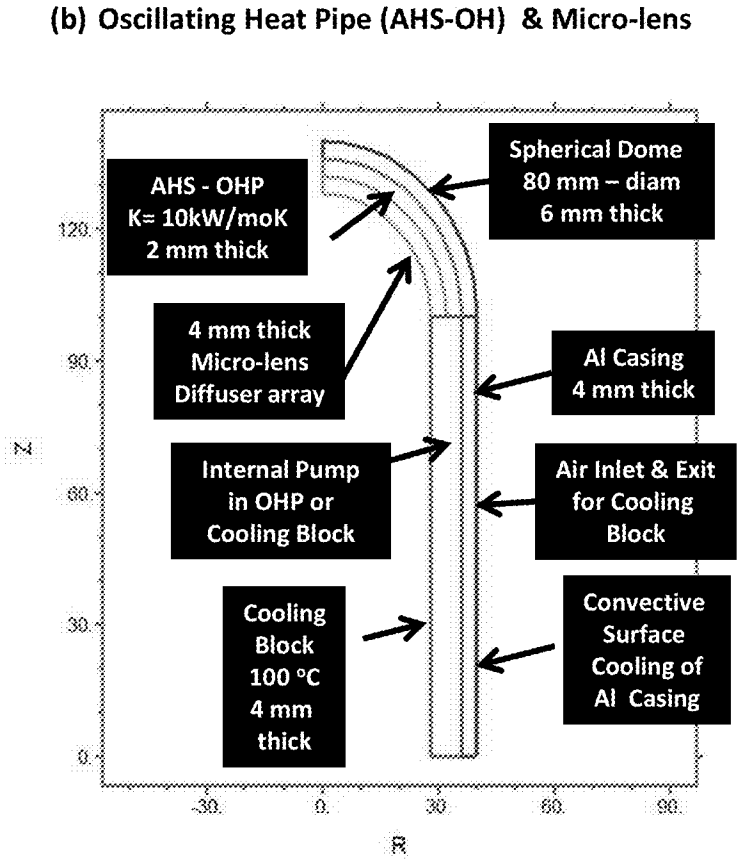
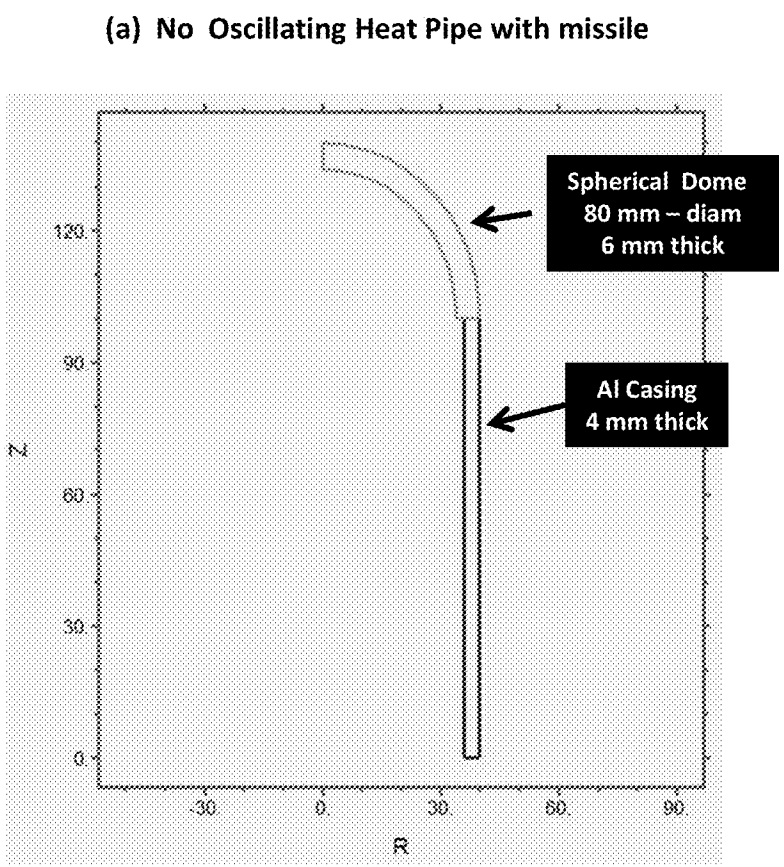
Fig. 2

Optical diagram of a typical passive non-imaging seeker.

(a) Oscillating Heat Pipe (AHS-OH) & Micro-lens diffuser array integrated with missile *& both OHP & micro-lens diffuser cooled by cooling block*
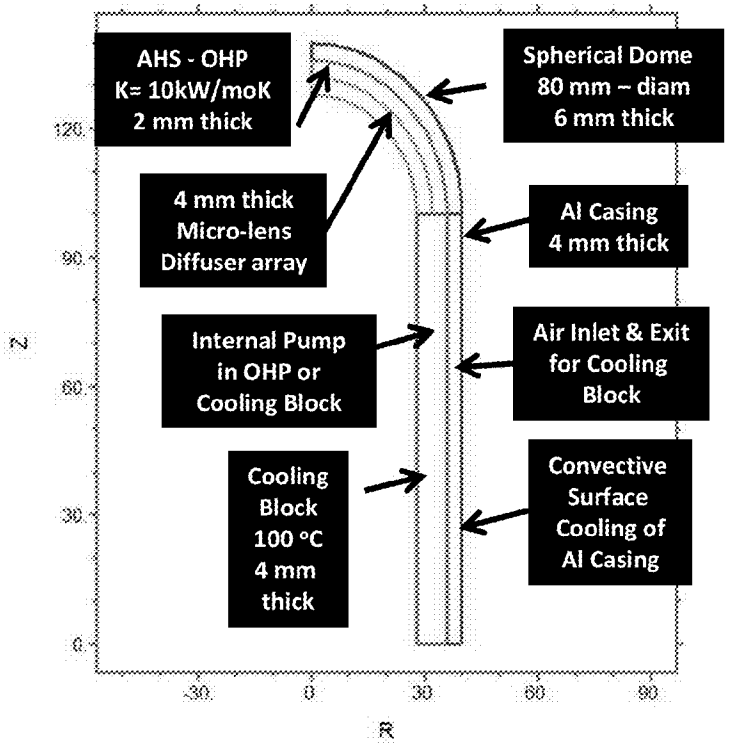
(b) Oscillating Heat Pipe (AHS-OH) & Micro-lens diffuser array integrated with missile *& only OHP cooled by cooling block*
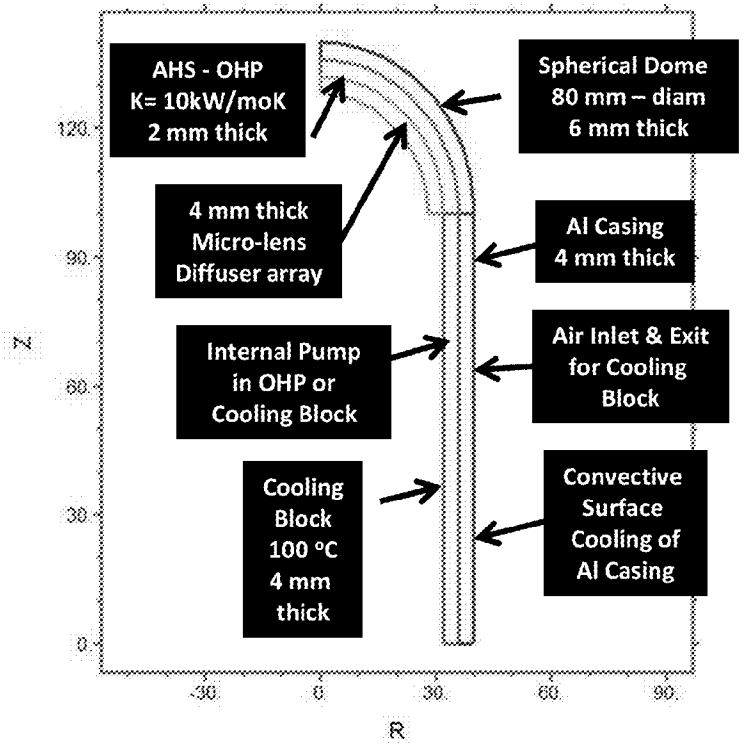
Fig. 4

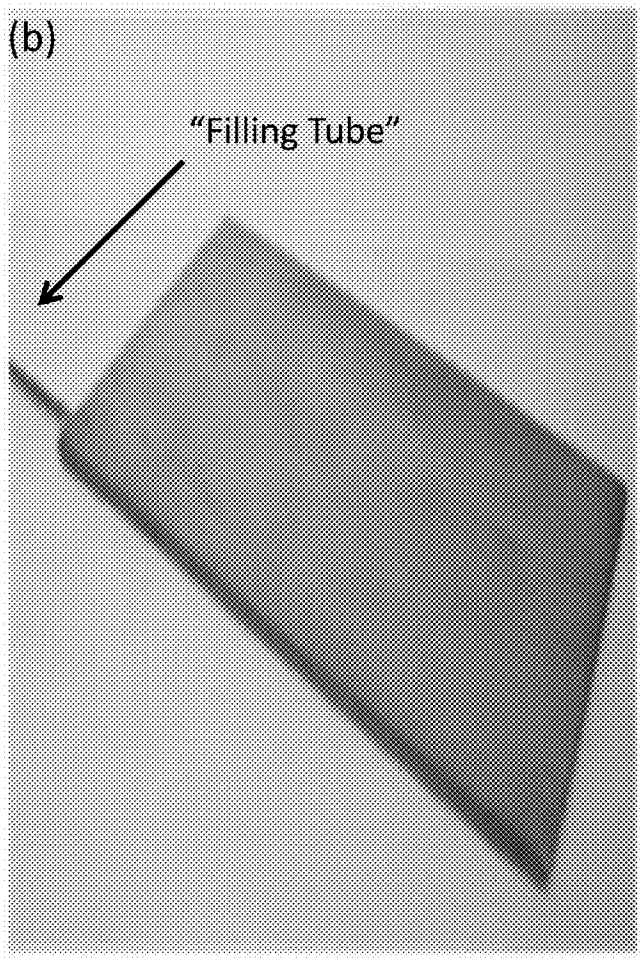
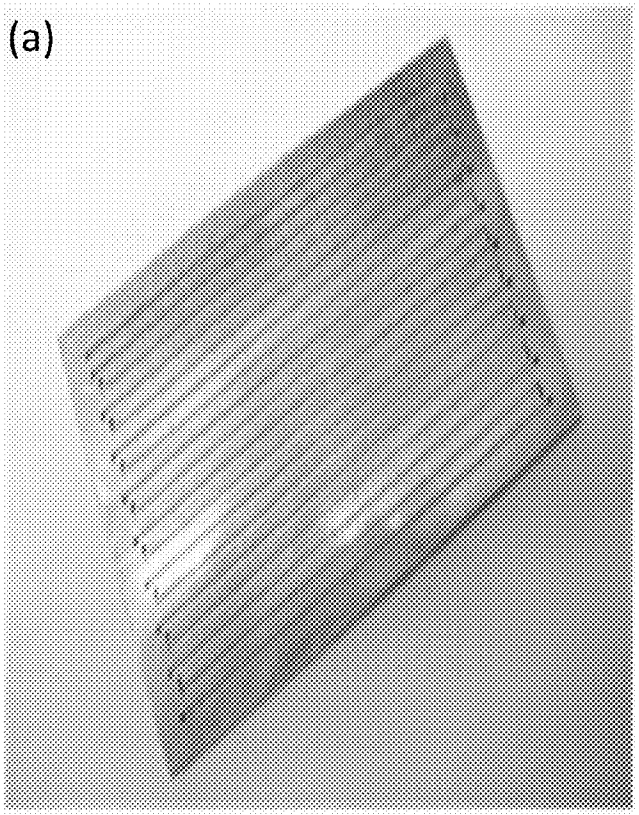
Fig. 9

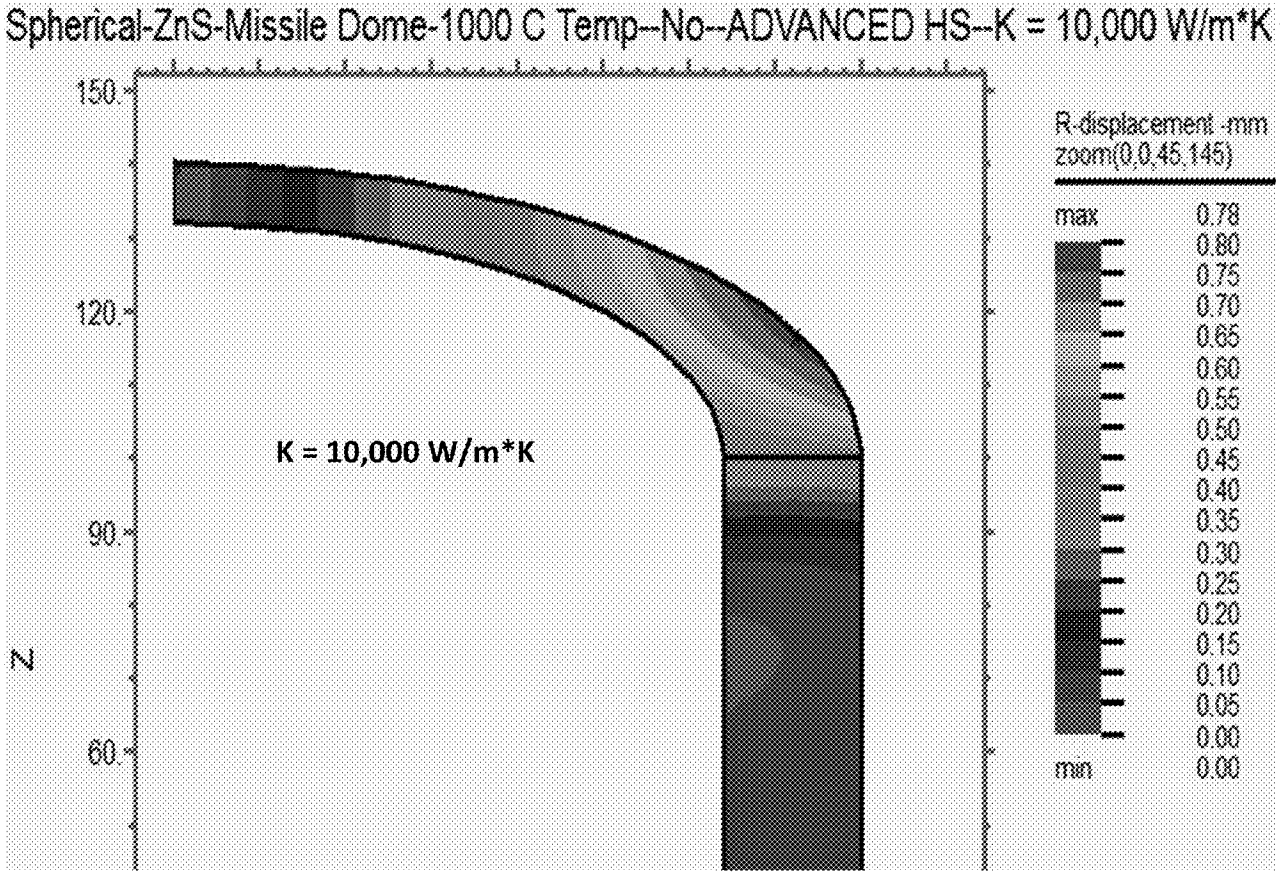
Fig. 20-a

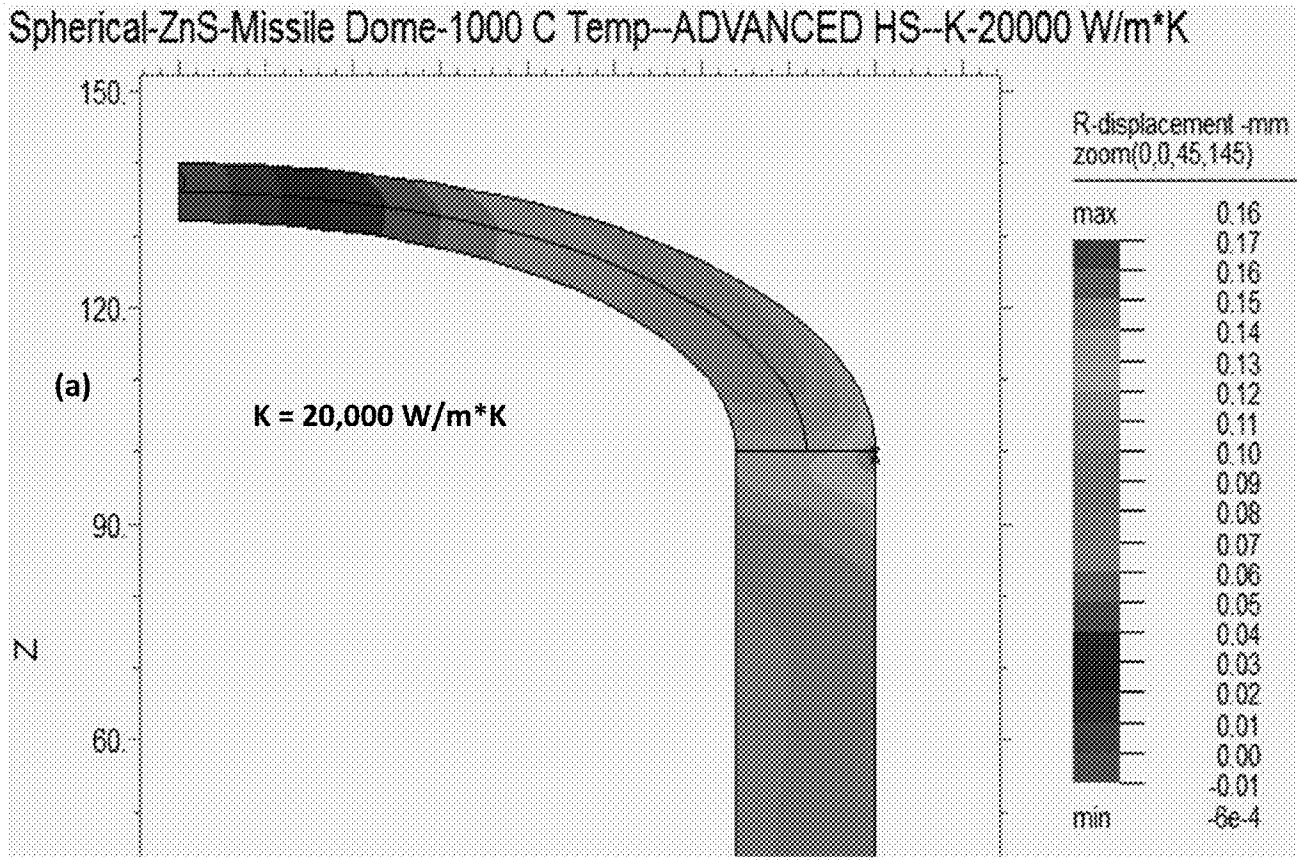
(a)
(b)
Fig. 20-b

*Microlens Beam Homogenizer*

Microlens Beam Homogenizer

Fly's Eye Condensor (a) Oscillating Heat Pipe with Missile
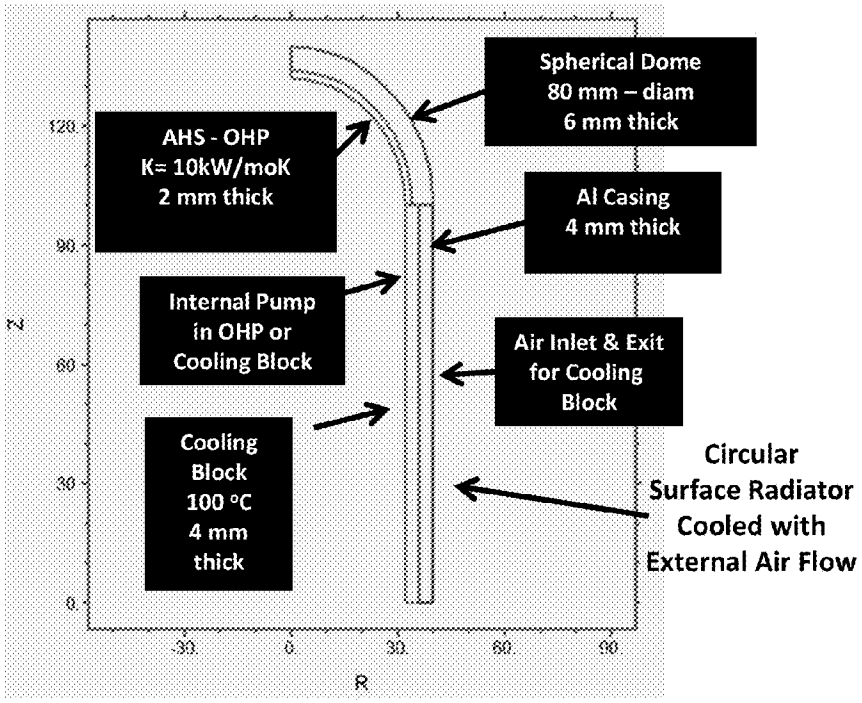
(b)
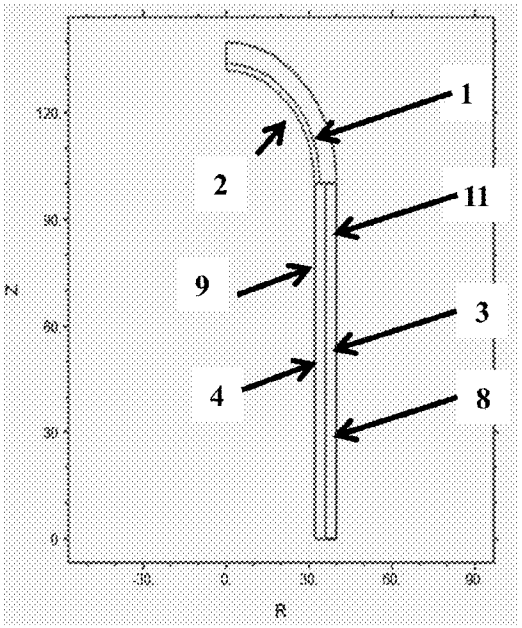
Fig. 24

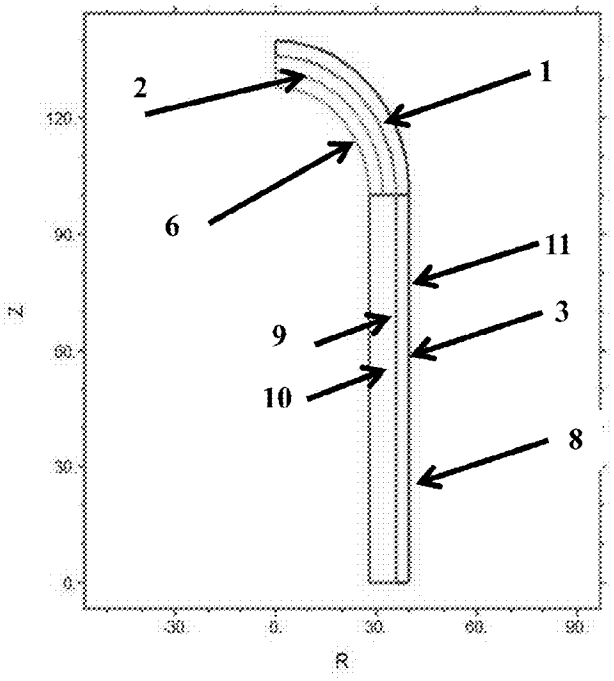
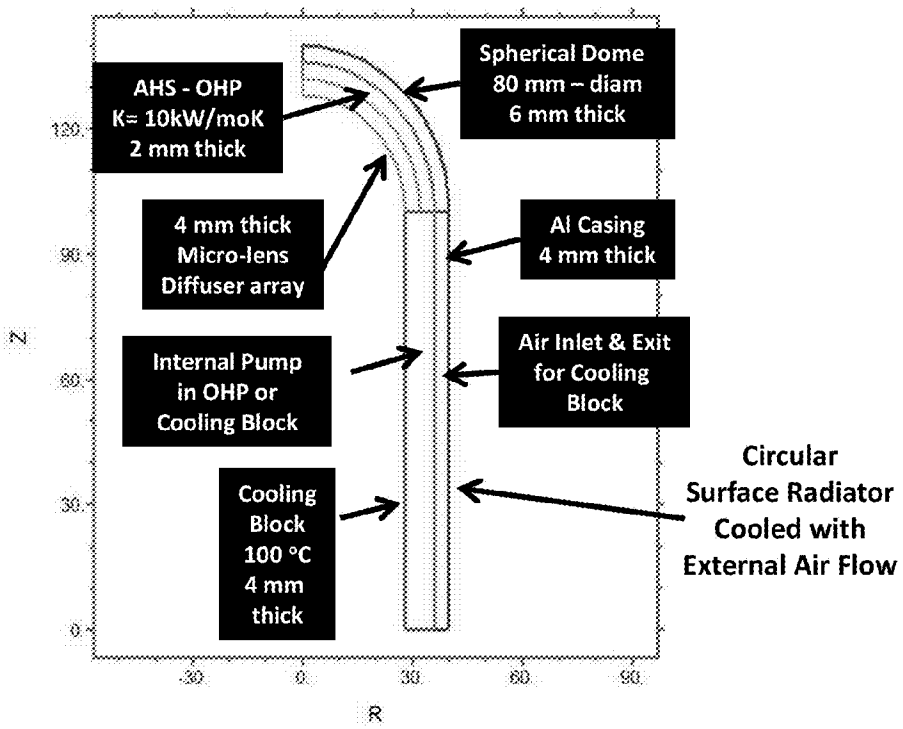
Fig. 26

ACTIVE COOLING OF HIGH SPEED SEEKER MISSILE DOMES AND RADOMES

CROSS-REFERENCE TO RELATED APPLICATIONS

This application claims priority to and the benefit of the filing of U.S. Provisional Patent Application Ser. No. 61/658,681, entitled "Active Cooling of High Speed Seeker Missile Domes and Radomes", filed on Jun. 12, 2012, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to methods and apparatuses for heat spreading on the back surface of seeking missile window domes and radomes.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

During the flight of infrared (IR) and radio frequency (RF) seeking missiles for various engagement scenarios, the temperature of both the infrared window domes and RF ceramic radomes experience very high heat loads from the compressed air in flight, resulting in very significant temperature gradients across and through this section of the missile. These temperature effects are very transient during flight and also create significant stresses which can easily lead to structural failure of the missile. Much work has been reported on the behavior of these effects as reported by various US companies [C. A. Klein, "Infrared Missile Domes: Heat Flux and Thermal Shock", SPIE Proceedings, Vol. 1739, pp. 230-253 (1992); R. L. Gentilman, et. al, "Thermal Shock Resistance of Convectively Heated Infrared Windows and Domes", SPIE Proceeding, Vol. 3060, pp. 115-129 (1997); Ceradyne, Inc., "Radomes and Ceramic Radomes for Missile Systems"] and now the Chinese academic institutions. [J. Zhenhai, et al., "Thermal-structure analysis of supersonic dome based on three materials", IEEE Article No. 5777830, 2011; W. Ziming, "The Calculating Models of Cooling IR Window and Window Background Radiation", Vol. 3375, pp. 195-202 (1998)] Temperatures of these windows and radomes can be near and often exceed 1000° C., levels which can affect both their survivability and performance. Previously, there have been ablative approaches to remove the thermal heat from the radomes as described in U.S. Pat. No. 4,949,920 (Schindel); U.S. Pat. No. 5,340,058 (Holl); and U.S. Pat. No. 5,457,471 (Epperson), but the present inventive approach using advanced oscillating heat pipe technology coupled with forced convection of the "working fluid" offers a significant improvement. In addition, the present invention is applicable to both IR seeking window domes and RF guided radome type nose cone shells.

Features of the present invention include the design, fabrication and integration of active cooling heat spreaders on the back surface of missile domes, radomes, or windows to enhance their performance. FIGS. 1-4 illustrate the application of using these advanced heat spreaders to cool the missile dome or radome from their high temperature experienced during flight. This active cooling approach uses oscillating heat pipes (OHP) that have demonstrated effective thermal conductivities of 10-20,000 W/m·K. In addition, this active cooling component can be fabricated from same materials as the dome or radome, thereby matching the coefficient of thermal expansion (CTE). Such a condition can significantly reduce the transient and/or near-equilibrium stress in the dome or radome produced by thermal gradients during missile's travel at speeds of Mach 3-6. Another attractive operating feature of these closed-loops OH P's is that they perform better as the thermal heat density increases. Finally, integrating a very small pump, <1 $inch^3$ in volume, such as DARPA's recently developed piezo-electric driven devices into the OH P's closed loop, the heat removal can be enhanced by forced convection (FC) of OHP's "working fluid" to heat removal greater than $kW/cm^2$ from the back surface of the missile dome or radome.

Operation of Oscillating Heat Pipes and Forced Convective OHP or FC-OHP

FIG. 5 shows the basic concept principle of single loop oscillating heat pipes (OHP) and lists their important features. This advanced heat spreader uses capillary heat pipe (HP) action in a closed loop channel that contains no "wicks" like open loop heat pipes. The large "effective" thermal conductivity is created as a result of the unidirectional flow (often aided by internal check-valves) and the evaporation-condensation action of "working fluid", i.e., the latent heat of vaporization, a thermal process called "oscillating motion of the liquid plugs and vapor bubble". The pressure created during "working fluid" vaporization creates the oscillatory motion, typically 20 kHz. [C. Wilson, et. al., "Visual Observation of Oscillating Heat Pipes Using Neutron Radiography", J. of Thermophysics and Heat Transfer, Vol. 22, pp. 366-372 (2008)] This "Heat Pipe Action" can be promoted by various "working fluids" such as water, acetone and ammonia at room temperature (RT), nitrogen for cryogenic operation and with alkali and other metal vapors at temperatures toward 100° C. and higher. Akachi as disclosed in U.S. Pat. Nos. 4,921,04 and 5,219,020 pioneered this new device, which utilizes the pressure change in volume expansion and contraction during phase change to excite the oscillation motion of the liquid plugs and vapor bubbles. This OHP has at least four important features that do not exist in regular heat pipes:

(1) OHP is an "active" cooling device, in that it converts intensive heat from the high-power generating device into kinetic energy of the "working fluid" in support of the oscillating motion;

(2) Liquid flow does not interfere with the vapor flow in high heat removal because both phases flow in the same direction;

(3) The thermally-driven oscillating flow inside the capillary tube will effectively produce some "blank" surfaces that significantly enhance evaporating and condensing heat transfer; and (4) The oscillating motion (≅20 kHz) in the capillary tube significantly enhances the forced convection in addition to the phase-change heat transfer. [S. P. Dad, et. al., "Thermally induced two-phase oscillating flow inside a capillary tube", Internat. J. of Heat Mass Transfer, Vol. 53, p. 3905 (2010); C. Wilson, et al., "Visual Observation of Oscillating Heat Pipes Using Neutron Radiography," Journal of Thermophysics and Heat Transfer, Vol. 22, No. 3, pp. 366-372 (2008)].

Large heat transfer, however, does not exist for a single loop OHP of FIG. 5 but does with the multiple loop design show in FIG. 6. Here, the OHP is still a single closed loop and the "working fluid" oscillates back and forth through the loop thereby transferring heat energy from the evaporator to the condenser with an effective high thermal conductivity. This oscillation of the "bubbles" and "plugs" and convective movement provides significant heat transfer. FIG. 7 illustrates a "picture" of the dynamics of a capillary OHP having different regions of "bubbles" and "plugs" which can be viewed. These oscillations have been measured to be 20 kHz (5) corresponding to 50 μsec durations which promotes near isothermal conditions for the material containing the grooves of these advanced heat spreaders.

Major Technical Advance in High Thermal Conductivites: K-Values >10,000 W/m*° K

FIG. 8 shows recent data on the performance of a newly developed oscillating heat pipe (OHP) by Prof. Ma's group at the University of Missouri. It shows the first demonstration of an oscillating heat pipe having a thermal conductivity greater than 10,000 W/m*° K a value 4-5 times sapphire. This OHP, FIGS. 9*a*, -*b* and 10 was fabricated and operated in the following manner:

Total thickness is 3 mm and consists of a 0.5 mm top and 0.5 mm bottom plate bonded onto a 2 mm middle plate section having 0.76 mm square, connecting grooves on both sides as shown in FIGS. 9 and 10. The "working fluid", acetone or water, was introduced via the fill-port, FIG. 9*b*, and the Flat-Plate (FP)OHP structure was Cu. These rows of grooves on both top and bottom (not shown) of the center piece shown in FIG. 9*a* are connected through grooves at the ends. FIG. 10 provides a cross section of this FP-OHP of FIG. 9*b*. Heat was applied by a 1 square inch heating element on one side of the heat spreader's evaporator section and heat was removed from the spreader's condenser. Very good insulation surrounding the heat spreader's edge adiabatic section assured negligible heat removal from the edges. Two cooling blocks attached to the spreader's condenser area were cooled with 60° C. water. The oscillating heat pipe had a dimension of 13 cm×4 cm and 0.3 cm thick. The key to fast flow is due to narrow grooves, nominally 700 microns diameter. This OHP, FIGS. 9*a* and *b* were tested in the following procedure: Heat was applied by a 1 square inch heating element on one side of the heat spreader's evaporator section, and heat was removed from both sides of the spreader's condenser section with good insulation surrounding the adiabatic sections. The approach for making such a "heat spreader" operate at higher powers, kW/cm$^2$, necessary for the removal of high heating power density from the missile windows and radomes is to use a mechanically-controlled, two-phase heat pipe as shown in FIG. 11 and described in U.S. Pat. No. 8,213,471 (Schlie). An IR or RF missile integrated with this novel heat spreader having effective thermal conductivity $K_{eff}$≅10-20,000 W/m·K will significantly lower the missile dome or radome, respectively, operating temperature. In addition, there should also be a significant increase in thermal conductivity when the heat flux increases as FIG. 8 shows.

The improved Oscillating Heat Pipe heat exchanger system shown in FIG. 11 using the mechanically controlled, two phase oscillating motion of the working fluid of the heat pipe can achieve much higher effective thermal conductivity and resultant heat transfer values, greater than kW/cm$^2$, a value never before conceived or demonstrated. Further enhanced performance, however, can be achieved via use of nanoparticles and nanofluids inside of the working fluid. [H. B. Ma, et al., "Nanofluid Effect on the Heat Transport Capability in an Oscillating Heat Pipe," Applied Physics Letters, Vol. 88 (14), p. 1161 (2006)] to acquire the lower temperature behavior of the backside of the missile window or radome. This effect is discussed below and data illustrating this enhancement is shown in FIG. 12. In addition, this integrated window or radome-unique heat pipe thermal management system allows good CTE (coefficient of thermal expansion). This condition exists since the material used to make the heat pipe system can be made from basically any material including the missile material itself as like similar dome material used for OHP bonded together, an arrangement which could provide nearly perfect CTE over the entire operating temperature range from sub-cryogenic to greater than room temperatures. In addition, a 50% improvement of OHP can be obtained using dispersed nanofluids in the working fluid of the OHP as shown in FIG. 13. High heat transport capability of nanofluids produced by adding only a small amount of nanoparticles into the fluid has qualified nanofluids as a most promising candidate for achieving ultra-high-performance cooling. and significant increase in critical heat flux (CHF) In addition, the heat transport capability in the nanofluid OHP depends on the operating temperature. When the operating temperature increases, the heat, transport capability significantly increases. In addition, the temperature difference between the evaporator and condenser is almost constant as the input power increases.

Referring back again to FIG. 5*b*, the figure highlights some of the major features of oscillating heat pipes. Of these properties, four of these are very significant, namely: there no wicks in the capillary or grooves of the OHP unlike conventional heat pipes; the external thermal heat for convective flow of the "working fluid" of the OHP; the system is a closed loop system; and "near perfect" CTE matching on bonded surface between materials occur for all temperatures.

The very large thermal conductivity of the above described Flat Plat-Oscillating Heat Pipe (FP-OHP), FIG. 8, can be fabricated from any material including the most common dome material, namely ZnS, $Al_2O_3$ or $MgF_2$ or radome ceramic, fused silica or silicon nitride material.

Again, FIG. 11*a* illustrates a simple application of the OHP described in FIGS. 5-7 in which the heat source is a hot plate and jet impingement cooling with a cooled fluid like water. FIG. 11*b* shows the integration with an internal pump to enhance the OHP heat transfer [U.S. Pat. No. 8,213,471 (Schlie); U.S. Provisional Application Ser. No. 61/512,730] which does the following: rapidly removes heat from the dome with thermal conductivity >10,000 W/m·K; spreads and transfers this thermal energy to the two cooling blocks on each end of FC-OHP; and has heat removed from cooling blocks into the coolants.

Such a configuration can remove large heat intensities, greater than kW/cm$^2$. The type of oscillating heat pipe shown in FIG. 11, operating only by the thermal excitation causing a net convective movement of the "working fluid" "bubbles" and "plugs", cannot remove heat power flux levels more than 0.3 kW/cm2. Due to the limitations existing in the conventional single phase flow, vapor chamber and oscillating heat pipe, a novel mechanically-controlled hybrid oscillating two-phase system, as shown in FIG. 11, is employed for this High-Speed Radome invention. This type of mechanical driven by using an internal pump causes the oscillating "working fluid" to convectively move uni-directionally through the closed loop structure and capable of providing heat removal fluxes of greater than $kW/cm^2$.

When heat continuously increases in the thermal load, such as in a missile dome or radome, currently available cooling devices such as liquid cooling such as used in the jet impingement cooling approach cannot meet the requirement. This is attributed to the capillary limitation, boiling limitation, vapor flow effect, and thermal resistances occurring in the wicks significantly limit the heat transport capability. Therefore, in order to develop a highly efficient cooling system to remove the extra-high heat flux and significantly increase the effective thermal conductivity, the mechanically controlled hybrid heat pipe of the invention is proposed and discussed in detail below. Later the details of the use of the a spherically configured equivalent oscillating heat pipe having features like the FP-OHP of FIG. 8 and FIG. 9 will be discussed. Here the application of the OHP to serve as an Advanced Heat Spreader will be integrated with dome structure of the missile improves its performance for reliability, improved tracking and increased speed.

Additional Aspects of Advanced Thermal Management with OHP

To provide a greater appreciation of the merits of the OHP of the invention, a discussion of certain main concepts must be provided, namely for thin film evaporation, thermally excited oscillating motion, nanofluid, and nanostructure-modified wicks.

Thin Film Evaporation.

In the presence of a thin film, a majority of heat will be transferred through a very small region. [M. A. Hanlon et al., "Evaporation Heat Transfer in Sintered Porous Media," ASME Journal of Heat Transfer, 125, pp. 644-653 (2003); S. Demsky, et al., "Thin film evaporation on a curved surface", Microscale Thermophysical Engineering, 8, 285-299 (2004); H. B. Ma, et al., "Fluid Flow and Heat Transfer in the Evaporating Thin Film Region," Microfluidics and Nanofluidics, Vol. 4, No. 3, pp. 237-243. (2008)] When evaporation occurs only at the liquid-vapor interface in the thin-film region, in which the resistance to the vapor flow is negligible, evaporating heat transfer can be significantly enhanced, resulting in much higher evaporating heat transfer coefficient than boiling heat transfer coefficient with enhanced surfaces. [J. R. Thome, Enhanced Boiling Heat Transfer, Hemisphere Publishing Corporation, (1990) New York; R. L. Webb, 1994, Principles of Enhanced Heat Transfer, John Wiley & Sons, Inc, New York; M. Kaviany, 1995, Principles of Heat Transfer in Porous Media, Springer, New York; Liter, S. G., and Kaviany, M., 2001, "Pool-boiling CHF Enhancement by Modulated Porous-Layer Coating: Theory and Experiment," International Journal of Heat and Mass Transfer, 44, pp. 4287-4311] Utilizing this information, a number of high heat flux heat pipes have been developed at the University of Missouri (MU). The micro-grooved heat pipe, 6-mm diameter and 135-mm length, for example, produces a temperature drop of only 2° C. from the evaporator to the condenser under a heat input of 50 W. The air-cooled aluminum heat pipe developed at MU, as another example, can remove a total power of 200 W with a heat flux up to 2 $MW/m^2$. Utilizing and optimizing thin film regions will significantly increase the heat transport capability and effectively increase the effective thermal conductibility of the vapor chamber.

High Heat Transport Capability of Nanofluids.

High heat transport capability of nanofluids produced by adding only a small amount of nanoparticles into the fluid has qualified nanofluids as a most promising candidate for achieving ultra-high-performance cooling. Argonne National Laboratory [Choi, S. U.S., 1995, "Enhancing Thermal Conductivity of Fluids with Nanoparticles," Developments and Applications of Non-Newtonian Flows, Amer. Soc. of Mech. Eng., New York, FED—Vol. 231/MD-Vol. 66, pp. 99-105] has demonstrated that the dispersion of a tiny amount of nanoparticles in traditional fluids dramatically increases their thermal conductivities. Since 1995, outstanding discoveries and seminal achievements have been reported in the emerging field of nanofluids. The key features of nanofluids discovered so far include thermal conductivities far above those of traditional solid/liquid suspensions [J. A. Eastman, et al., "Anomalously Increased Effective Thermal Conductivities of Ethylene Glycol-Based Nano-Fluids Containing Copper Nano-Particles," Applied Physics Letters, Vol. 78, p. 718 (2001)]; a nonlinear relationship between thermal conductivity and concentration [S. U. S. Choi, et al., "Anomalous Thermal Conductivity Enhancement in Nano-tube Suspensions," Applied Physics Letters, 79, pp. 2252-2254 (2001)]; strongly temperature-dependent thermal conductivity [S. K. Das, et al., "Heat Transfer in Nanofluids—A Review," Heat Transfer Engineering, Vol. 27(10), p. 3 (2006)]; and significant increase in critical heat flux (CHF). [Y. Xuan, et al., "Investigation on Convective Heat Transfer and Fluid Features of Nanofluids," *Journal of Heat Transfer,* 125, pp. 151-155 (2003); I. C. Bang, et al., "Boiling heat transfer performance and phenomena of $Al_2O_3$-water nano-fluids from a plain surface in a pool," International Journal of Heat and Mass Transfer, Vol. 48 (12), p. 2407 (2005)] These key features make nanofluids strong candidates for the next generation of coolants to improve the design and performance of thermal management systems. Most recently, Ma's group at MU [Y. Zhang, et al., "Nonequilibrium heat conduction in a nanofluid layer with periodic heat flux,": International Journal of Heat and Mass Transfer, Vol. 51(19-20), p. 4862 (2008); H. B. Ma, et al., "An Experimental Investigation of Heat Transport Capability in a Nanofluid Oscillating Heat Pipe," ASME Journal of Heat Transfer, Vol. 128, p. 1213 (2006); H. B. Ma, et al., "Nanofluid Effect on the Heat Transport Capability in an Oscillating Heat Pipe," Applied Physics Letters, Vol. 88 (14), p. 1161 (2006)] charged the nanofluids into an oscillating heat pipe (OHP) and found that nanofluids significantly enhance the heat transport capability in the OHP. When the nanofluid (HPLC grade water containing 1.0 vol. % 5-50 nm of diamond nanoparticles) was charged to the OHP, the temperature difference between the evaporator and the condenser can be significantly reduced. For example, when the power input added on the evaporator is 100 W, the temperature difference can be reduced from 42° C. to 25° C. It appears that the nanofluid can significantly increase not only the effective thermal conductivity, but also the convection heat transfer and the thin film evaporation in the OHP. The heat transport capability in the nanofluid OHP depends on the operating temperature. When the operating temperature increases, the heat transport capability significantly increases. The temperature difference between the evaporator and condenser was almost constant as the input power increases, and the investigated OHP with charged nanofluids can reach 0.028° C./W at a power input of 336 W, which might set a record of thermal resistance in the similar cooling devices.

Theoretical Approach (Modeling and Optimizing Design)

Thin Film Evaporation.

To confirm the superior capabilities of nanofluids in high-heat removal, Demsky and Ma's model [S. Demsky, et al., "Thin film evaporation on a curved surface", Microscale Thermophysical Engineering, 8, 285-299 (2004)] was extended to explore evaporating heat transfer through a thin nanofluid film, assuming a 0.2% volume fraction of $Al_2O_3$ added into water as the working fluid. The heat flux in the thin-film region now peaks at 11.6 $MW/m^2$ for a superheat of 1.0° C., over 50 percent increase than that in regular fluids, indicating that the nanoparticles can indeed significantly increase evaporating heat transfer through the thin film region. Most excitingly, as the liquid phase continuously vaporizes and consequently the volume fraction of nanoparticles in the thin film region further increases, the effective thermal conductivity of nanofluids becomes higher which may result in even higher heat transfer rates than that [H. B. Ma, et al., "An Experimental Investigation of Heat Transport Capability in a Nanofluid Oscillating Heat Pipe," ASME Journal of Heat Transfer, Vol. 128, p. 1213 (2006)] Effective heat removal also assures temperature uniformity across the evaporating section. Higher thermal conductivity of nanofluids, in addition, will reduce the thermocapillary flow in the thin film region, which significantly assists the nanofluid in passing the thin film region and thus remarkably raise the dryout limit. Using the newly developed model [I. C. Bang, et al., "Boiling heat transfer performance and phenomena of $Al_2O_3$-water nano-fluids from a plain surface in a pool," International Journal of Heat and Mass Transfer, Vol. 48 (12), p. 2407 (2005)], heat transfer and fluid flow in thin film region occurring in the nanostructure wicks will be predicted and the optimum design for the wicks to be used in the evaporating section of the proposed system will be obtained.

Thermal Modeling of Oscillating Motion.

In order to exploit the superior performance of nanofluids for heat transfer enhancement, a number of nanofluid OHPs shown in FIG. 9 was developed and tested in Dr. Ma's Lab and found that the nanofluids significantly enhance the heat transport capability in an oscillating heat pipe [Borgmeyer, B. et al., "Experimental Investigation of Oscillating Motions in a Flat Plate Pulsating Heat Pipe," AIAA Journal of Thermophysics and Heat Transfer, Vol. 21, No. 2, pp. 405-409, (2007); K. Park et al., "Nanofluid Effect on the Heat Transport Capability in a Well-Balanced Oscillating Heat Pipe," AIAA Journal of Thermophysics and Heat Transfer, Vo. 21, No. 2, p. 443 (2007); Qu, W. et al., "Theoretical Analysis of Start-up of a Pulsating Heat Pipe," International Journal of Heat and Mass Transfer Vol. 50, pp. 2309-2316 (2007)]. Experimental results show that the nanofluid can enhance the oscillating motion of working fluid in the OHP and the temperature difference between the evaporator and the condenser can be reduced significantly as shown in FIG. 12. Clearly, the combined strengths of high-conducting nanofluids, superior evaporating heat transfer rate in thin nanofluid films, and oscillations have resulted in an excellent cooling rate. Examining the total thermal resistance from the evaporator to the condenser, the thermal resistances for the wall were the same for both cases. In other words, the decrease of temperature difference was only from the fluid phase. This means the nanofluids have much more of an effect than the data shown in FIG. 13.

Features of the Inventive High Performance Oscillating Heat Pipe System for Lower Temperature Operation of Missile Window Domes or Ceramic Radomes The mechanically-controlled two-phase oscillating motion of the invention can reach a very high flow rate, which can reach an extra high level of temperature uniformity resulting in higher than all other kinds of heat pipes including the standard vapor chamber.

The hybrid system of the invention utilizes both the sensible and latent heats to transport heat from the hot area to the cold area while the conventional heat pipes including the vapor chamber transport heat only by the latent heat. Due to the latent heat, the temperature distribution can reach a high level of uniformity. The preferred nanostructures modify the evaporating surface and maximize the thin film evaporation, resulting in an unprecedented evaporating heat transfer rate.

Due to the oscillating motion, the nanofluid can be used, which will significantly increase the heat transport capability. The plasma-nano-coated surface can modify the condensing surface resulting in high condensing heat transfer rate. Due to the two phase system, the pressure drop is much lower than that of single liquid phase, which can produce an extra high flow rate.

The system of the invention effectively integrates extra high level of heat transfer rate of thin film evaporation, high thermal transport capability of nanofluids, low pressure drop, and strong oscillating motions controlled by mechanical system, which can result in an extra high heat transport capability.

In addition to the phase change heat transfer, the strong oscillating motion of nanofluids existing in the system of the invention results in additional vortex in the liquid plugs significantly enhancing the heat transfer rate.

FIG. 11*a* illustrates a simple application of the OHP described in FIGS. 5-10 where the heat source is a hot plate and jet impingement cooling with a cooled fluid like water. FIG. 11*b* shows an application to a missile flat dome as an illustrative example. Under the dome window which may be at 1000° C., a bonded convectively forced OHP's "working fluid" evaporation-condensation process would do the following: rapidly removes heat from the dome with thermal conductivity >10,000 W/m·K; spreads and transfers this thermal energy to the two cooling blocks on each end of FC-OHP; and has heat removed from cooling blocks into the coolants.

Such a configuration can remove large heat intensities, greater than $kW/cm^2$. For the use with this invention, the dome would either a truncated hemisphere or configured a conformal optic dome have more of pointed center shape. These current type of oscillating heat pipe operating only by the thermal excitation causing a net convective movement of the "working fluid" "bubbles" and "plugs" cannot remove heat power flux levels more than 0.3 $kW/cm^2$. Due to the limitations existing in the conventional single phase flow, vapor chamber and oscillating heat pipe, a novel mechanically-controlled hybrid oscillating two-phase system, as shown in FIG. 11, are preferably employed for the invention. This type of mechanical driven by using an internal pump causes the oscillating "working fluid" to convectively move uni-directionally through the closed loop structure and capable of providing heat removal fluxes of greater than $kW/cm^2$.

For the internal pump, a very small piezoelectric actuator pump operating at high pressure and speed is preferred. Such small pumps, such as shown in FIG. 15, create pressures greater than 2500 psi and are approximately 0.6 inch diameter and 1 inch in length plus have an inlet and outlet port which is compatible with the above described OHP. These pumps are available from, for example, Kinetic Ceramics, Inc in Hayward, Calif. These types of piezoelectric fluid pumps have the following unique features:

Solid-state piezoelectric drive with direct electromechanical energy conversions
No electromagnetic fields
High power density and high efficiency
Fast starting times and no electric motor or solenoids
Robust and reliable operation
High output pressure and flow rates
Output pressure to 2500 psi
Flow rates to 40 cc/sec
Small dimensions and aluminum housing
Weights of 275-450 grams
Compact electronic drives with less space required
Metering capability of pressure and flow velocities Concept for Integrating Oscillating Heat Pipe with Dome Window To appreciate the value of these types of oscillating heat pipes with their thermal conductivities greater than 10,000 W ° K, an analysis of the temperature profile and thermally induced strain or deformations effects was made. FIG. 1*b* depicts one side of an axisymmetric, cross-sectional view of a conceptual missile design having an oscillating heat pipe integrated with a spherical dome missile. The oscillating heat pipe is placed on the back surface of the dome which is connected to a cooling block bonded to the inside of the missile casing shown in FIG. 1*b* which is different from FIG. 1*a* having no such OHP. In this conceptual missile of length 1 meter and 8 cm diameter of FIG. 1*b*, the missile has an 80 mm diameter ZnS spherical dome window of 6 mm thickness. It is assumed that it is heated uniformly across the entire surface to 1000° C. (≅1250° K) by the near Mach 3-6 flow conditions. The aluminum side casing is 4 mm thick. On the back surface of the ZnS dome of 6 mm thickness is the 2 mm thick convectively forced OHP with K=10,000 W/m·K effective thermal conductivity. This configuration is similar in concept to the design shown in FIG. 11*b* for a mechanically controlled, Forced Convective Oscillating Heat Pipe, namely FC-OHP. Very important to note is that the OHP bonded inside the hemispherical dome covers all of the dome inside surface and hemispheric. The internal pump, like illustrated in FIG. 15, is not shown but identified by the arrowed block called "Internal Pump in OHP or Cooling Block". The thermo-mechanical values for aluminum were Poisson ratio=0.33, Young modulus=70.3 GPa and coefficient of thermal expansion (CTE)=23.6 μm/m·K while for ZnS, these respective values were, 0.27, 114.37 GPa and 10.4 μm/m·K. Only axisymmetric conditions are considered in this cw analysis. The cooling blocks are to be cooled by aerodynamic cooling effects on the outside aluminum casing which can be utilized surface radiators on external on internal part of missile casing walls or sides.

Analysis of Thermal Behavior for Integrated OHP with Missile Dome Window

For comparison purposes, the analysis was performed for both case of FIG. 1 for conditions without and with the OHP bonded on the inside surface of the spherical of the ZnS dome window. Also for simplicity, it was assumed that cooling block still existed on the aluminum casing walls (FIG. 1*b*) and for the case of no OHP, the 2 mm thickness was replaced by ZnS thus making it also 8 mm thick. The result without the OHP is that the entire dome becomes in equilibrium the same temperature as the front surface, i.e., 1000° C., FIG. 16. In addition, at the junction at interface between the ZnS dome and the aluminum casing has significant temperature gradient which results in strong thermally induced stresses. Similar analysis for ZnSe and $CaF_2$ produced similar behavior. For brevity, only the ZnS results are presented here. Using the OHP with an "effective" K=10,000 W/m·K illustrates the real value of this thermal management approach as show in FIG. 17 showing the significantly lower temperature of dome. With the cooling blocks at 100° C., enable by aerodynamic cooling of the outside air, the entire ZnS back surface is reduced down to by at least by 50%, a truly very valuable feature. Benefits of this reduced temperature is reduced large thermal stresses plus less blackbody radiant heat introduced into the infrared tracking by the radiating ZnS back surface into the sensor system of the missile. FIGS. 16-19 show the computed temperature profiles for various conditions, namely, FIG. 16 is case for no cooling, FIG. 17 is for a 2 mm active cooler-heat spreader bonded on back side of a 6 mm thick ZnS and with a K=10,000 W/m·K. FIG. 18 is same as FIG. 17 except K=20,000 W° K and FIG. 19 is for 4 mm active cooler-heat spreader bonded on back side of a 4 mm thick ZnS with K=20,000 W/m·K. It is easy to notice the benefits of the use of these oscillating heat pipes to remove heat from the dome which will also reduce the thermally induce stresses.

In FIG. 20, the deformations or displacements in the R-directions are shown for the two cases of (1) no active cooler-heat spreader, FIG. 20*a* which is related to temperature profile in FIG. 16 and (2) for a 4 mm active cooler-heat spreader bonded on back side of a 4 mm thick ZnS with K=20,000 W/m·K which is related to the temperature profile of FIG. 19. For case (1) a maximum R-displacement value of 780 microns is experienced in the ZnS dome windows but this is reduced to a maximum of 160 microns for case (2), a very significant difference which means less thermally created strain in the ZnS. Although there are different configurations of OHP with missile dome windows, the possible design tradeoffs offers the potential to establish an optimum design configuration to enhance the performance of actively cooled missile via the information provided in this invention. All of the results of FIGS. 1, 16-20 illustrate the value of integrating OHP with the window dome or radomes of the either heat seeking or RF guided missiles.

Based on the experimental investigation by Ma [Liter, S. G., and Kaviany, M., 2001, "Pool-boiling CHF Enhancement by Modulated Porous-Layer Coating: Theory and Experiment," *International Journal of Heat and Mass Transfer,* 44, pp. 4287-4311 (2001)], the diamond nanoparticles are preferred because Ma and his researchers have conducted reliable tests for the nanofluid oscillating heat pipe and found the heat transfer performance is constant over the two-year testing. In other words, the evidence shows that the nanofluid (diamond nanoparticles) oscillating heat pipe has not deteriorated from the available tests. The diamond nanoparticles can be purchased from Nano Plasma Center Co., Ltd. with a very low price. While the diamond with a large size is very expensive, the price for diamond particles with a size about 50 nm is very low. For example, 500-gram diamond nanoparticles cost about $150, which can make over 100 heat spreaders proposed herein. Using the lathe, milling machine, and high temperature brazing furnace equipped in ThermAvant, the oscillating heat pipe similar to those shown in FIG. 18 can be readily fabricated. In order to develop a low cost fabrication process, the fabrication processes of casting and mold, milling by the lathe and milling machine, and brazing will be conducted.

The design of the OHP for the missile domes and radomes preferably utilizes the extra-high evaporating heat transfer of thin film evaporation, strong oscillating motion, higher heat transport capability of nanofluids, and nanostructure-modified surfaces and wicks to significantly increase the heat transport capability in the proposed hybrid phase-change heat transfer device. FIG. 27 illustrates six designs for the hybrid mechanically-controlled oscillating two-phase system schematically illustrated in FIG. 11. In order to form a very strong oscillating motion with high frequency, the oscillating motion will be mechanically controlled. A train of vapor bubbles and liquid plugs will flow through the channel with high speed. The channel wall, which will be fabricated from the microstructured wick, the solid line shown in six version for OHP shown in FIG. 27 will be used as the evaporating surface. The channel shape, channel arrangement, and channel number will depend on the total power, heat flux level, and heat sources. The open region between the liquid plugs will have an extra fast evaporation rate through nanostructure wicks. The pore size in the evaporating section must be optimized in order to have the maximum number of the thin film regions, excellent wetting characteristics, and optimum thickness for the maximum boiling limit. The wicks in the condensing area must be optimized to significantly increase the condensing heat transfer by using hydrophobic surfaces. The wetting characteristics will gradually vary from the perfectly wetting condition (hydrophilic) in the evaporating section to the partially wetting (hydrophobic) in the condensing section. The flow path for the liquid flow from the condensing section to the evaporating section will be optimized to significantly reduce the pressure drop.

When heat is added on the evaporating region of the microstructured surface from the heat source, as shown similar to FIG. 9 for the different version shown in FIG. 27, the heat is transferred to both the liquid plugs (sensible heat) and the region between the liquid plugs (latent heat). As the heat reaching the region between the liquid plugs, it is transferred through the nanostructure wicks and to the liquid-vapor interface, where the thin evaporation heat transfer occurs. The vapor generated in these areas will be immediately removed by the mechanically-controlled two-phase flow, and directly brings the heat from the evaporating (hot) area to the condensing (cold) area and condenses into liquid. The condensate is preferably pumped back by the mechanical controlled oscillator. When the total power and the heat flux level are high, the capillary force produced in the wick cannot overcome the pressure drop in the wick, the vapor chamber will reach the capillary limit, which is the reason why the current available heat pipe, although it is much better than single phase heat transfer cannot remove the heat at an extra-high level of heat flux such as occurring in the high power TDLs. When the input power is higher, while the oscillating motions of liquid plugs and vapor bubbles produced by the mechanically controlled oscillator can remove heat by the forced convection, it can directly help to bring condensate back to the evaporating surface. More importantly, the oscillating motion can make it possible to use nanofluid as the working fluid. Although the nanofluid has been introduced about 10 years ago, no application is available until the nanofluid oscillating heat pipe is developed. [K. Park, et al., "Nanofluid Effect on the Heat Transport Capability in a Well-Balanced Oscillating Heat Pipe," AIAA Journal of Thermophysics and Heat Transfer, Vo. 21, No. 2, p. 443 (2007); W. Qu, et al., "Theoretical Analysis of Start-up of a Pulsating Heat Pipe," International Journal of Heat and Mass Transfer Vol. 50, pp. 2309-2316 (2007; H. B. Ma, et al., "Heat Transport Capability in an Oscillating Heat Pipe," ASME Journal of Heat Transfer, Vol. 130, No. 8, p 081501 (2008)). The reason is that when the nanoparticles settle down, the heat transport capability of nanofluid significantly reduces. For the proposed system, the oscillating motion excited by the oscillator (which can reach a high frequency) directly disturb the nanoparticles and make the nanoparticles to be suspended in the base fluid. The addition of nanoparticles into the base fluid can further increase the heat transport capability of the thin film evaporator on the microstructured surface. Due to the oscillating motions, the nanoparticles will not settle down. It should be noted that the nanoparticles will be added into the base fluid to be used in the proposed system.

The oscillating heat pipe charged with nanofluid preferably comprises three sections, i.e., evaporating section, adiabatic section, and condensing section. A cooling block connecting to a cooling bath is used to remove heat from the heat rejection section. Because the operating temperature directly increases the effective thermal conductivity of nanofluid and at the same time it will directly reduce the nanofluid viscosity, the operating temperature might have a significant effect on the heat transport capability. Using cooling blocks, the operating temperature are being varied from sub-zero to 200° C. Cryogenic operation also easily operate and often perform much better because most gaseous "impurities in the "working fluid" are frozen out. [H. Xu, et al., "Investigation on the Heat Transport Capability of a Cryogenic Oscillating Heat Pipe and Its Application in Achieving ultra-Fast Cooling Rate for Cell Verification Cryopreservation," Cryobiology, Vol. 56, pp. 195-203 (2008)].

The experimental results show that the turn and length of heat pipes directly affect the heat transfer performance of OHPs. For the nanofluid OHP, the heat pipe turn ranging from 4 to 20 are experimentally investigated in order to find the optimum turn number. In order to test the heat pipe, an experimental setup shown in FIG. 18 is being constructed consisting of a test section, a data acquisition system, a cooling bath, and a power supply and measurement unit. A test section consisted of the heat spreader embedded with nanofluid OHP proposed herein, cooling blocks, a heater and supporter. The test section supporter will be machined from an aluminum block and designed to allow for various setups. The two cooling blocks can easily be moved to either increase or decrease the size of the condenser region. A heater can easily be removed and replaced by one of a different size. The heater simulating the computer chip will be placed directly in the center of the heat spreader with adequate contact between the heater and heat spreader embedded with nanofluid OHPs. The heater will be surrounded by insulation to insure the heat flux is directed into the heat spreader. A Julabo cooling bath equipped in the company will be connected to the two aluminum cooling blocks in order to maintain a constant condenser temperature. A variable power supply is preferably connected to the heater which will be also connected to a digital multimeter. This will be to precisely determine the heat input to the heat spreader embedded with OHPs. Multiple type T thermocouples will be placed in the evaporator, condenser, and adiabatic regions to monitor the temperature throughout the heat spreader. An lotech data acquisition system will be used to obtain temperature readings from the thermocouples.

Required Properties of "Working Fluid" for Oscillating Heat Pipe

The selection of the correct working fluid is critical and preferred candidates have been identified. Its importance is due to the monitoring radiation must propagate through both the ZnS (and others like $MgF_2$ or $Al_2O_3$) and the OHP containing the "working fluid". Water and acetone are totally unacceptable due to their strong absorption. Some fluorocarbon liquids like FC-72 and FC-75 appear to be quite promising. For example, FC-75 H. Yoshida, et. al., "Heavy fluorocarbon liquids for a phase-conjugaged stimulated Brillouin scattering mirror", Applied Optics, Vol. 36, p. 3740 (1997)] has been used as a nonlinear liquid inside high power laser and FC-72 has already been demonstrated to be good "working fluid" for oscillating heat pipes.

Minimizing Diffractive Effects Created by OHP Structure

Integrating the grooved structure of the OHP shown in FIGS. 9 and 27 with the dome window or radomes will create diffractive effects in the amplitude and phase of the detected infrared and RF radiation being detected. Fortunately, because the RF radiation is large relative to groove space, sub-millimeter relative to centimeter for RF wavelengths, the concern deals predominantly with the IR tracking missiles. Fortunately, the use of micro-lens diffuser provides an excellent way to overcome any such diffractive effects for IR seeking missiles. FIGS. 21-22 show the excellent aspects of this technology. In addition these micro-lens diffuser can homogenize laser radiation from many sources to produce amplitude 2-D beam shapes with less than 1% non-uniformity. [http://www.suss-microptics.com] Also, the resultant radiation is totally incoherent. [B. Kohler, et. al., "11 kW direct diode-laser system with homogenized 55×20 $mm^2$ Top-Hat intensity distribution", Proc. SPIE 6456, paper 6456-22, (Feb. 7, 2007); D. Shafer; "Gaussian to flat-top intensity distributing lens"; Optics & Laser Technology, Vol. 14, Issue 3, pp. 159-160, (June 1982); M. Traub, et al., "Homogenization of high power diode laser beams for pumping and direct applications"; Proc. SPIE Vol. 6104, (February 2006)].

These micro-lenses can be made from silicon which would be a good IR transmissive material and very promising for integrating with AHS-OHP for cooling IR missile domes.

BRIEF SUMMARY OF THE INVENTION

The present invention is of a thermal management system and method for active cooling of high speed seeker missile domes or radomes comprising: bonding to an IR dome or RF radome a heat pipe system having effective thermal conductivity of 10-20,000 W/m*K and comprising one or more mechanically controlled oscillating heat pipes; employing supporting integrating structure including a surface bonded to the IR dome or RF radome that matches the coefficient of thermal expansion the dome or radome material and that of said one or more mechanically controlled oscillating heat pipes; and operating the heat pipe system to cool the IR dome or RF radome while the missile is in flight. In the preferred embodiment, pumping is employed to convectively move working fluid through the heat pipe system. The working fluid (preferably a nanofluid, and most preferably a diamond nanofluid) absorbs a pre-identified electromagnetic frequency to enhance performance of the dome or radome. A selective IR filter is employed of a pre-identified wavelength of blackbody for missile operations. The invention reduces transient thermal optical performance conditions for the IR dome or RF radome. An optical material is employed having thermal K>=10,000 W/m*K applied to the dome or radome. An n ablative thin film is employed to remove thermal heat. One or more micro-lenses are employed for a diffuser of IR or RF radiation to minimize diffractive effects arising from structural configuration of the heat pipe system on a back side of the dome or radome transmissive material.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 2. Pseudo-Missile for illustrating OHP Effects with and without active cooling and micro-lens diffuser array optical system Dome Window or Radome back surface, (a) Pseudo-missile with no OHP and micro-lens diffuser array optical system bonded to back surface and (b) Pseudo missile with both OHP and micro-lens diffuser optical system in sequence bonded to back surface and the cooling blocks at 100° C. bonded to missile casing inner wall.

FIG. 4. Pseudo-Missile for illustrating active cooling effects in the case of cooling only the OHP bonded to back surface of the Window Dome or Radome versus case where both the OHP and micro-lens diffuser array optical system are cooled by the "block cooler" (a) Pseudo missile with only OHP cooled and (b) Pseudo missile with both OHP and micro-lens array cooled by the "block cooler" at 100° C. which are both bonded "block cooler" that is also bonded to missile outside casing having aerodynamic radiator cooling. See FIGS. 24-26.

FIG. 9. OHP (a): Grooves in middle plate and (b) top cover with vacuum, "working fluid" fill-port.

FIG. 20. R-displacement (microns) of Dome temperature profile with (a) no advanced heat spreader on inside surface of missile dome and (b) with a 4 mm thick Advanced Heat Spreader, 4 mm thick ZnS dome & heat exchanger cooled internally to 100° C. Outer top surface of dome heated to 1000° C. at Mach 3-6.

FIG. 22. Example use of Microlens array system used to homogenize a laser beam with good uniformity and mode filling of either fibers or optical imaging systems like those involved in infrared tracking missile plus also RF guide missile radomes.

FIG. 23. Temperature profiles for Pseudo-Missile.

FIG. 24. Schematic of FC-OHP, Forced Convective-Oscillating Heat Pipe configured in missile for either a guided heat sinking or rf guided missile.

FIG. 26. Schematic of FC-OHP, Forced Convective-Oscillating Heat Pipe configured in missile for either a guided heat sinking or RF guided missile.

DETAILED DESCRIPTION OF THE INVENTION

Figure 1:
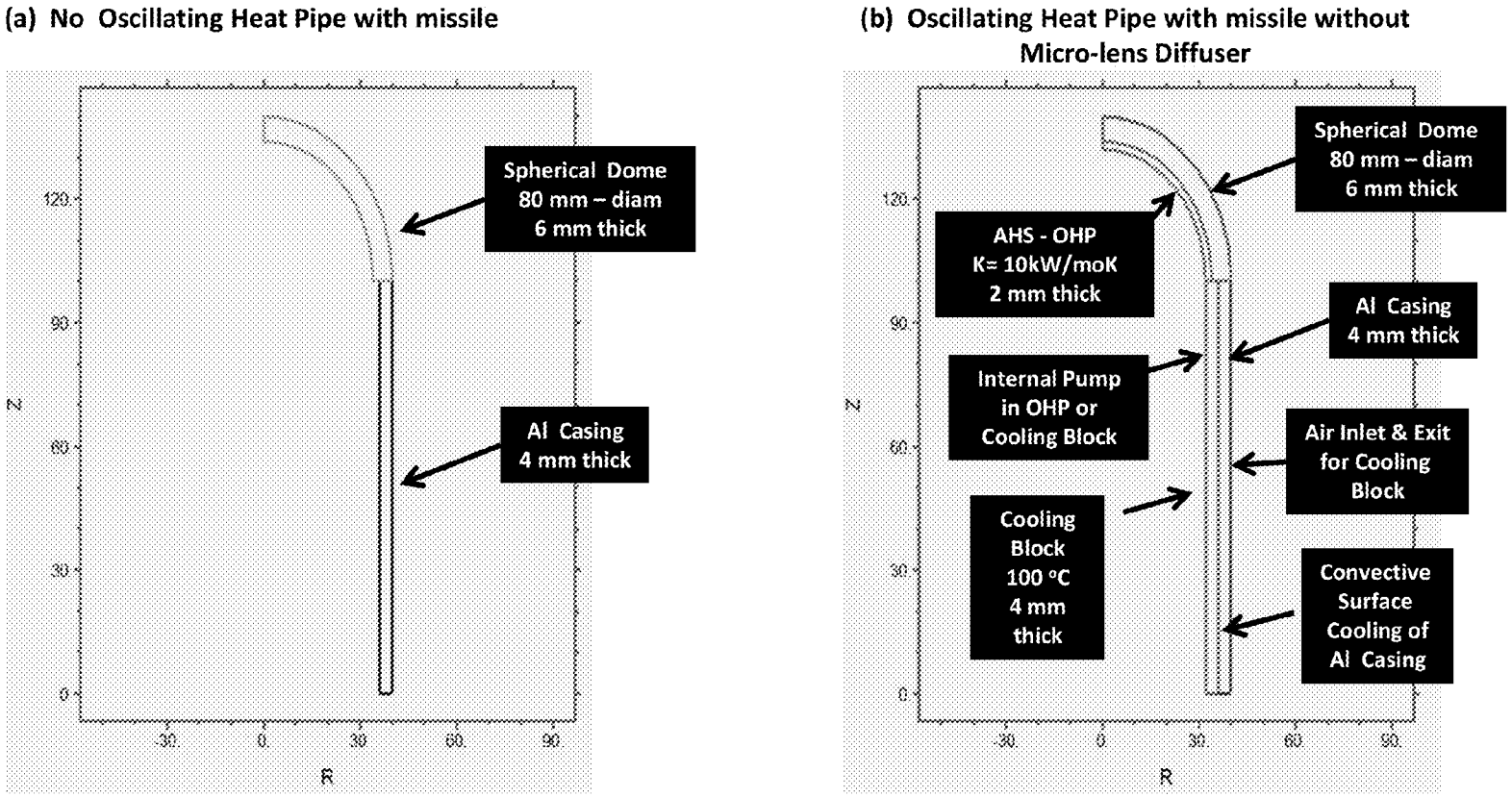
FIG. 1. Pseudo-Missile for illustrating OHP Effects with and without active cooling of Dome Window or Radome back surface, (a) Pseudo missile with no OHP bonded to Dome back surface and (b) Pseudo missile with OHP bonded to back surface and cooling blocks at 100° C. bonded to missile casing inner wall. No micro-lens diffuser array optical system exists.
Figure 3:
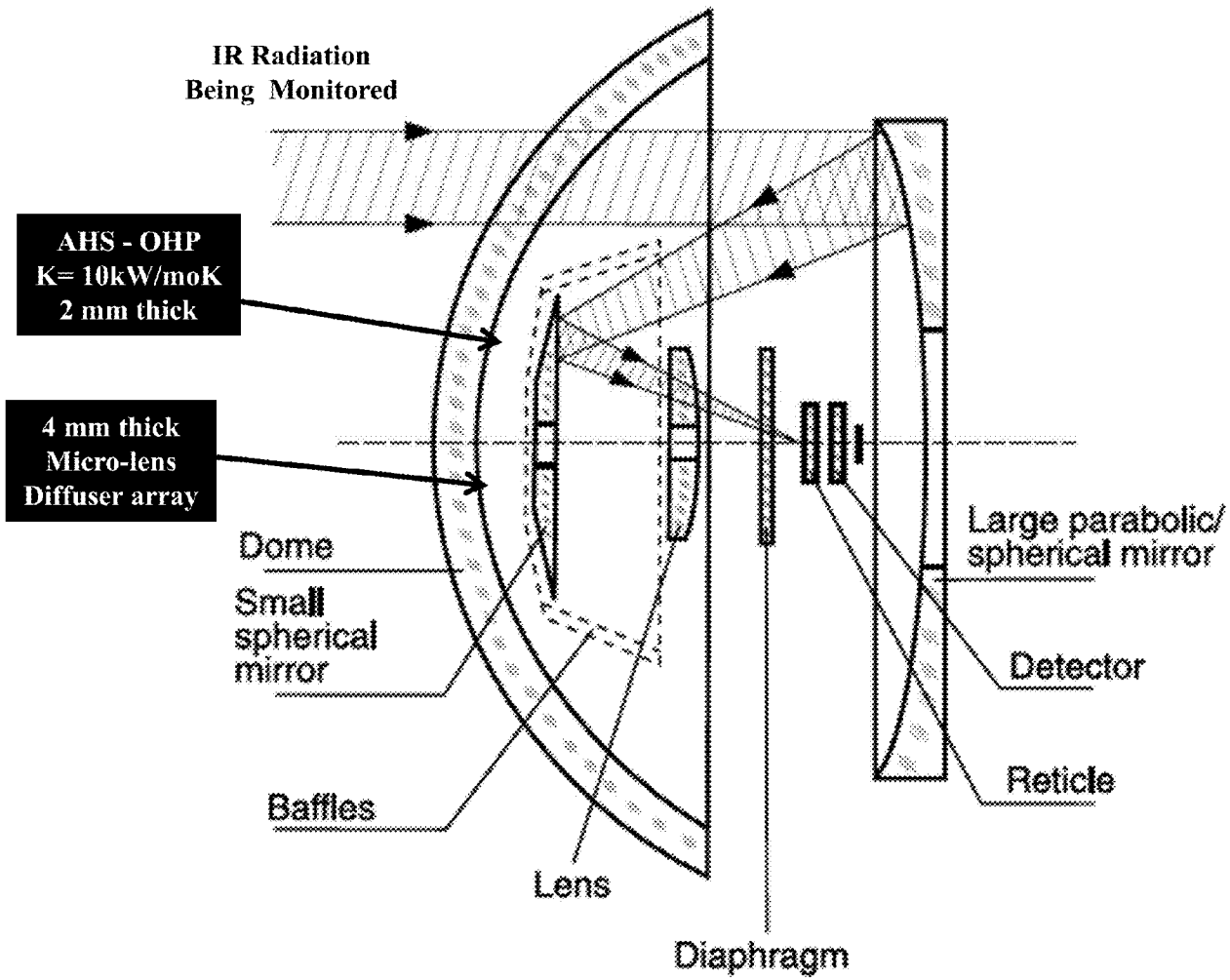
FIG. 3. Location of advanced heat spreader using oscillation heat pipe behind the dome IR transmitting window plus the micro-lens diffuser system on a typical passive non-imaging IR seeking missile. [A. Rogalski, et al., "Infrared devices and techniques," Opto-Electronics Review, Vol. 10, pp. 111-136 (2002)]
Figure 5:
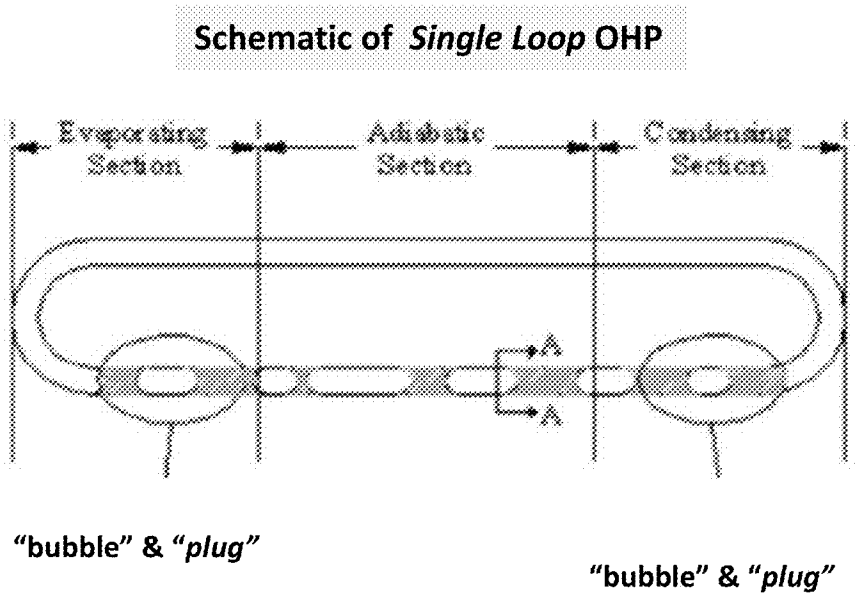
FIG. 5. Generic behavior of Closed Loop Oscillating Heat Pipe, (a) schematic of a single loop oscillating heat pipe illustrating "bubble & plugs" and (b) various features of OHP.
Figure 6:
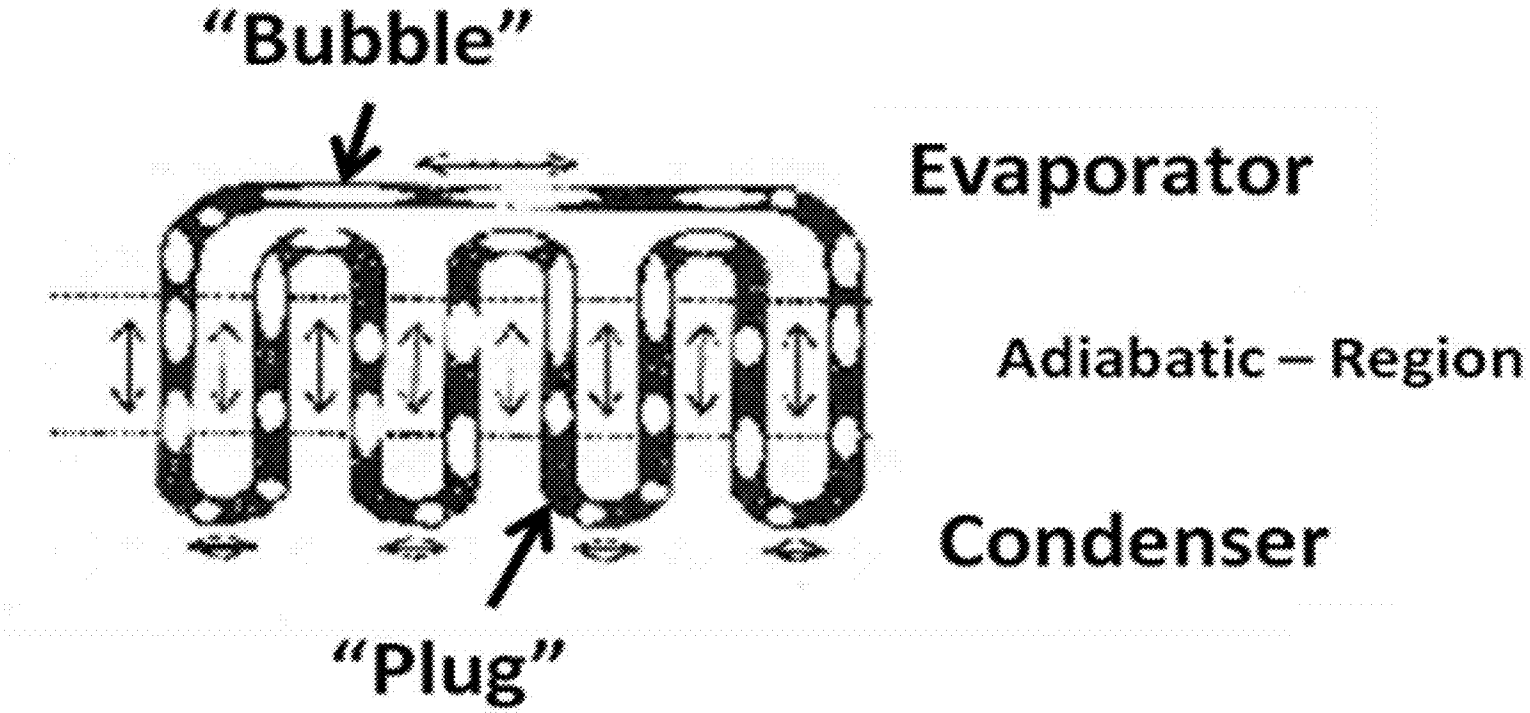
FIG. 6. Closed loop Oscillating Heat Pipe showing "bubbles" and "plugs" oscillating with this OHP.

The present invention provides an improved method of designing, fabricating and integrating active cooling heat spreaders on the back surface of IR-seeking missile window domes like ZnSe, ZnS, $CaF_2$ plus other IR transmitting materials and RF guided ceramic (or silicon carbide, fused silica or other materials) radomes to enhance their performance. This advanced heat spreader (AHS) coupled to either type of missile can significantly reduce the dome/radome temperature thereby providing improved missile performance and/or higher missile speeds and ranges The active cooling approach uses an oscillating heat pipes (OHP) that have demonstrated effective thermal conductivities of 10-20,000 W/m·K. Very important also is to minimize or completely eliminate any diffractive effects created by the structure of the OHP of this Advance heat Spreader. This potential disturbance is overcome by employing a micro-lens diffuser which is placed on the backside of the OHP-ADS structure. Due to the longer wavelength of the RF radiation being monitored, such diffractive effects should not be significantly lower and likely not to create any diffractive detrimental effects and likely have no need of a micro-lens diffuser. The possible index mis-match of the working fluid for the OHP creating Fresnel reflection losses of either the monitored/"tracking" IR or RF radiation will not create tracking issues since the micro-lens diffuser will homogenize the incoming IR being monitored. One aspect of this invention is the feature that this active cooling component can be fabricated from same materials as the dome or radomes, thus matching the coefficient of thermal expansion (CTE). Such a condition can significantly reduce the transient and/or non-equilibrium stress in both the IR-seeking domes and RF guided radome missiles produced by the thermal gradients during the missile's travel at Mach 3-6. Another attractive operating feature is that the OHP perform better as the thermal heat density increases. Finally, integrating a very small pump, <1 $inch^3$ in volume, such as the recently developed piezo-electric driven devices into the OHP's closed loop, the heat removal can be enhanced by forced convection (FC) of the OHP's "working fluid" to greater than $kW/cm^2$ from the back surface of the infrared seeking missile window dome or the radio frequency guided ceramic radomes. The heat is removed from the Forced Convective OHP (FC-OSHP) by flowing "working fluid" flows through thin surface radiator coupled with the external skin or wall of the missile. Other approaches employing external air flow and cooling also can be utilized as heat exchangers expending the thermal heat from the window dome or ceramic type radomes.

The encompassing methodology of active cooling of high speed missile domes and radomes comprises an integration of a novel heat spreader with an effective thermal conductivity of 10-20,000 W/m*K, an internal pump to the oscillating heat pipe (OHP) to enhance the heat removal at 100's to greater than 1000 $W/cm^2$ from the heated missile cone, which then expends this heat to the outside the missile via aerodynamic cooling of the missile casing. The potential significant decrease in the missile nose cone temperature during flight will improve its reliability by reducing the stress, extend its range and enable high speed operation. All of these features are possible across the MWIR (mid-wave infrared) and LWIR (long-wave infrared) wavelength bands by employing microlens diffusers to minimize diffractive viewing quality degrading effects due to the OHP structural components of grooves, "working Fluid" and refractive mismatches. This invention for active cooling high speed missiles is compatible with the missile's chromatic aberration control, negligible line-of-site pointing errors and image blur and thus retention of good viewing quality.

Figure 11:
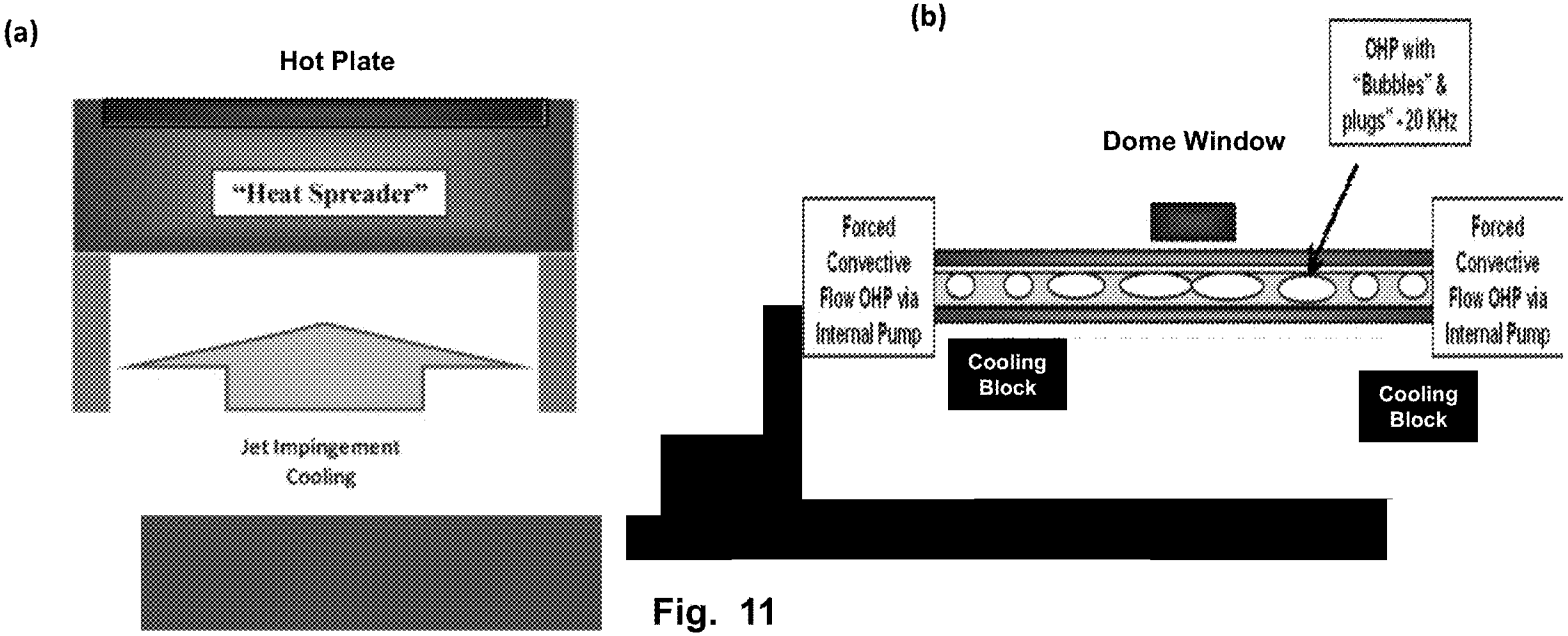
FIG. 11. Mechanically-controlled, oscillating two-phase flow, "Advanced Heat Spreader" for missile windows or domes, which has an "effective" thermal conductivity of 10-20,000 W/m ° K, (a) simple AHS design with hot thermal plate & jet impingement cooling and (b) AHS with missile dome window and coolant flowing through cooling block on both sides of FC-OHP. The "Forced-Convective-Oscillating Heat Pipe" is driven by a piezo-electric pump, FIG. 14.

The advanced heat exchanger (or advanced heat spreader) of the invention employs a mechanically controlled, two phase oscillating motion of the working fluid of heat pipe (FIG. 11) to achieve much higher effective thermal conductivity and resultant heat transfer, greater than $kW/cm^2$, a value never before conceived or demonstrated. Implementing a closed cycle fluid pump into the oscillating heat pipe (OHP) structure greatly improves the thermal conductivity at high fluencies due to the enhanced convection of the working liquid—vapor fluid than capable using the internal pressure created during the vaporization process of the OHP. Further enhanced performance is achieved via use of nanoparticles and nano-fluids inside of the working fluid to acquire the near isothermal control of the missile nose cone. In addition, this integrated missile nose cone—unique heat pipe thermal management system allows good CTE (coefficient of thermal expansion). This condition exists since the material used to make the heat pipe system can be made from basically any material including the missile IR or RF material itself as like either ZnS, ZnSe or $CaF_2$ for the IR and SiC and other refractory materials for the RF. This arrangement should provide nearly perfect CTE over the entire operating temperature range for the missile in-flight conditions.

The properties of this high performance system suitable for active cooling of missiles include:

The mechanically-controlled two-phase oscillating motion can reach a very high flow rate, which can reach an extra high level of temperature uniformity resulting in higher than all other kinds of heat pipes including the standard vapor chamber.

The hybrid system utilizes both the sensible and latent heats to transport heat from the hot area to the cold area while the conventional heat pipes including the vapor chamber transport heat only by the latent heat. Due to the latent heat, the temperature distribution can reach a high level of uniformity. Nanostructures used modify the evaporating surface and maximize the thin film evaporation, resulting in an unprecedented evaporating heat transfer rate.

Due to the oscillating motion, a nanofluid can be used, which significantly increase the heat transport capability.

The plasma-nano-coated surface can modify and improve the condensing surface resulting in high condensing heat transfer rate.

Due to the two phase system, the pressure drop is much lower than that of single liquid phase, which produces an extra high flow rate.

The hybrid system effectively integrates extra high level of heat transfer rate of thin film evaporation, high thermal transport capability of nanofluids, low pressure drop, and strong oscillating motions controlled by mechanical system, which results in an extra high heat transport capability.

In addition to the phase change heat transfer, the strong oscillating motion of nanofluids existing in this hybrid system will result in additional vortex in the liquid plugs that significantly enhancing the heat transfer rate.

Approach for Significantly Reducing Dome Heating with Oscillating Heat Pipes

Figure 7:
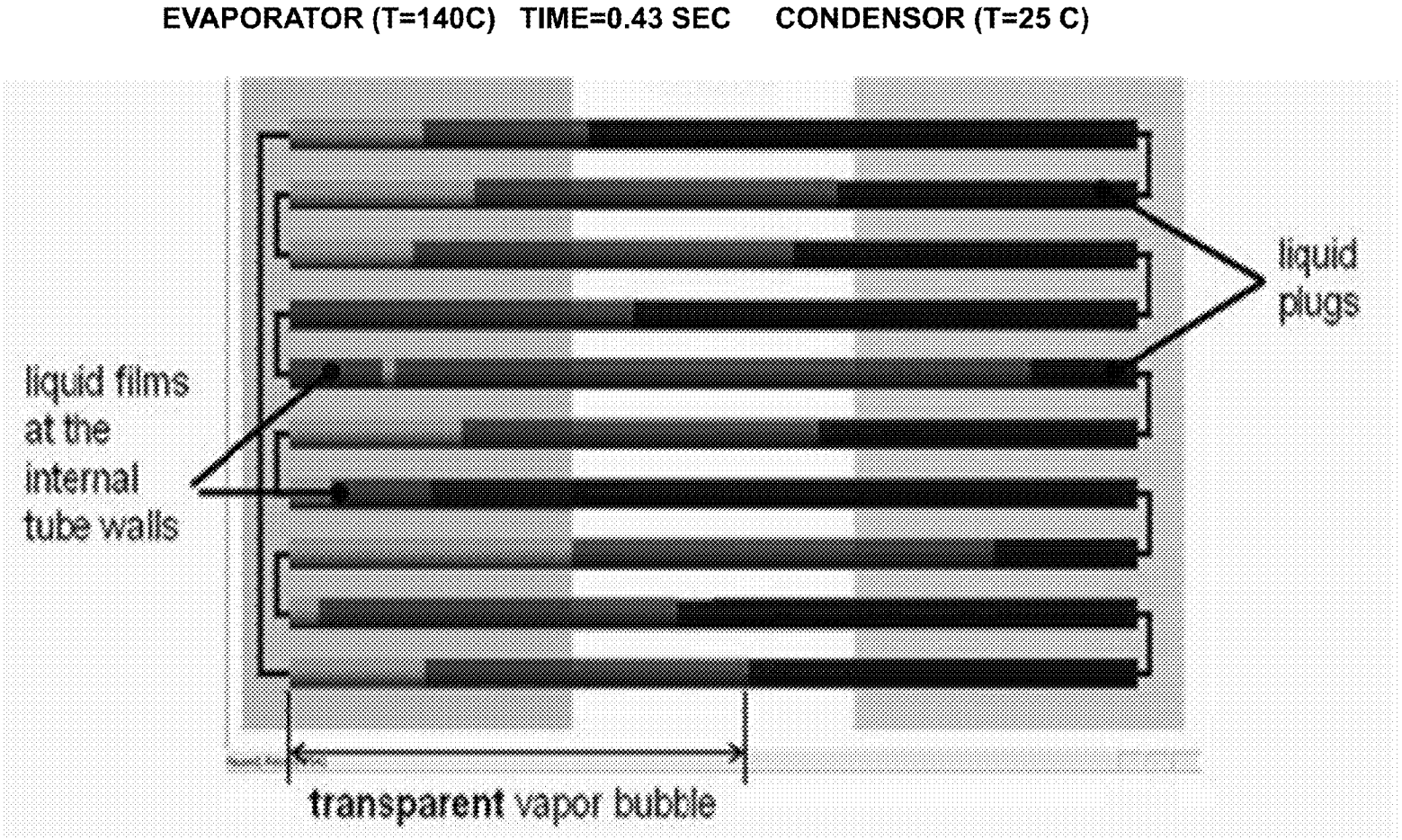
FIG. 7. Oscillating Heat Pipe of several "turns" and various positions of "bubbles" and "plugs" and their back and forth oscillations in either capillary tubing or grooves. [S. V. Nikolayef, "Modeling of pulsating heat pipe," pmmh/espci.fr/~vnikol/PHP.html]
Figure 14:
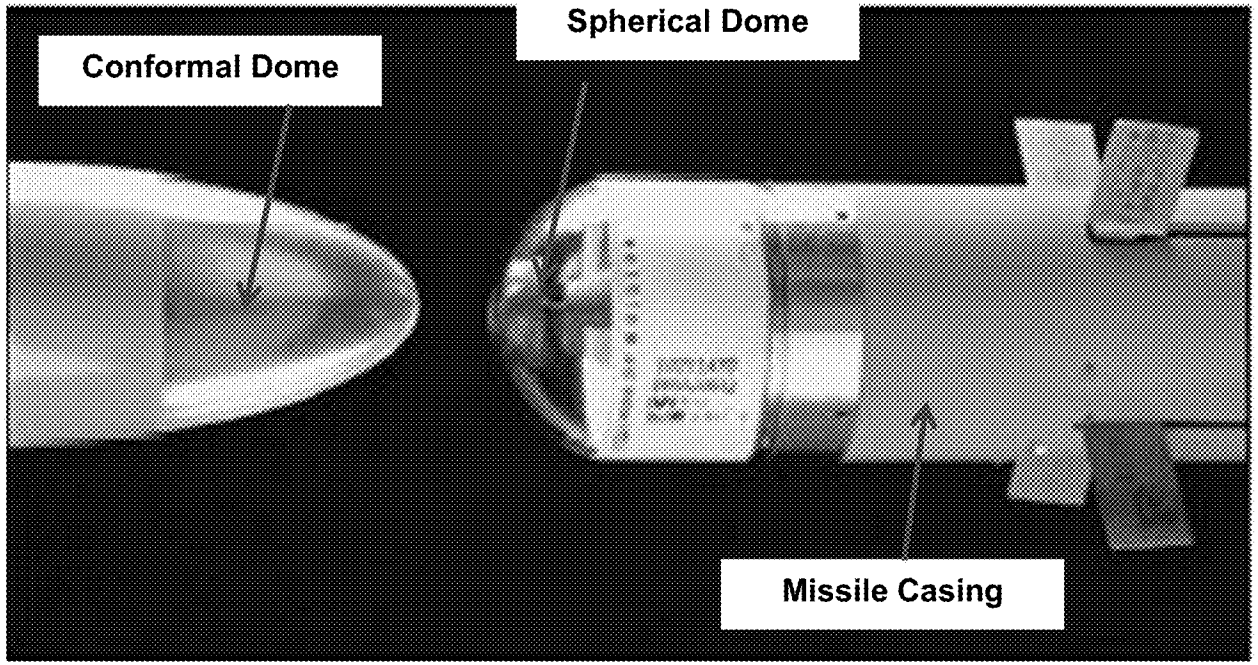
FIG. 14. Two types of missile domes being Conformal Optic dome (left) and Spherical Dome (right).
Figure 15:
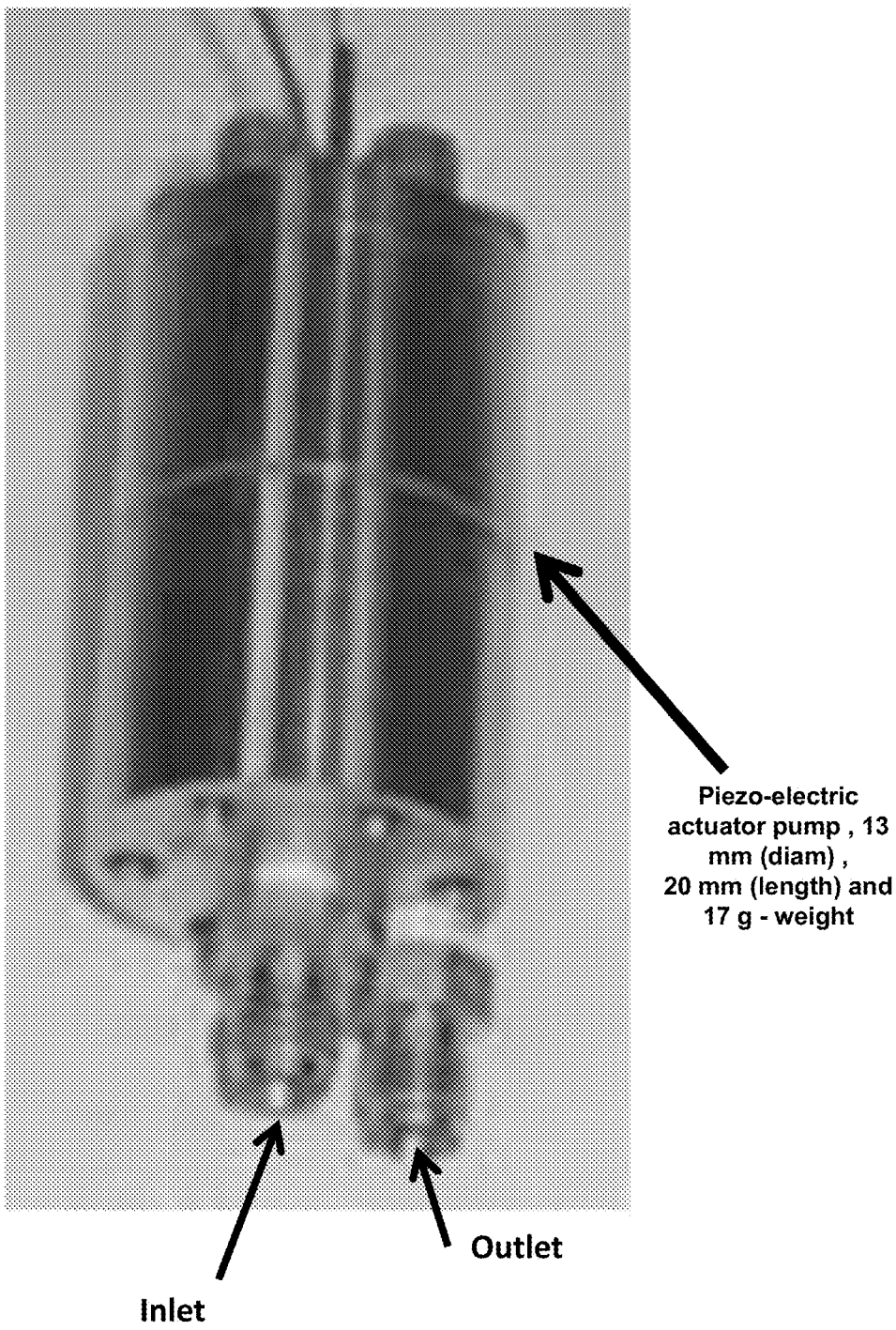
FIG. 15. Piezo-electric actuator pumps, 13 mm (diameter), 20 mm (length) and 17 g—weight. Reference is provides via for piezo-electric pump.
Figure 16:
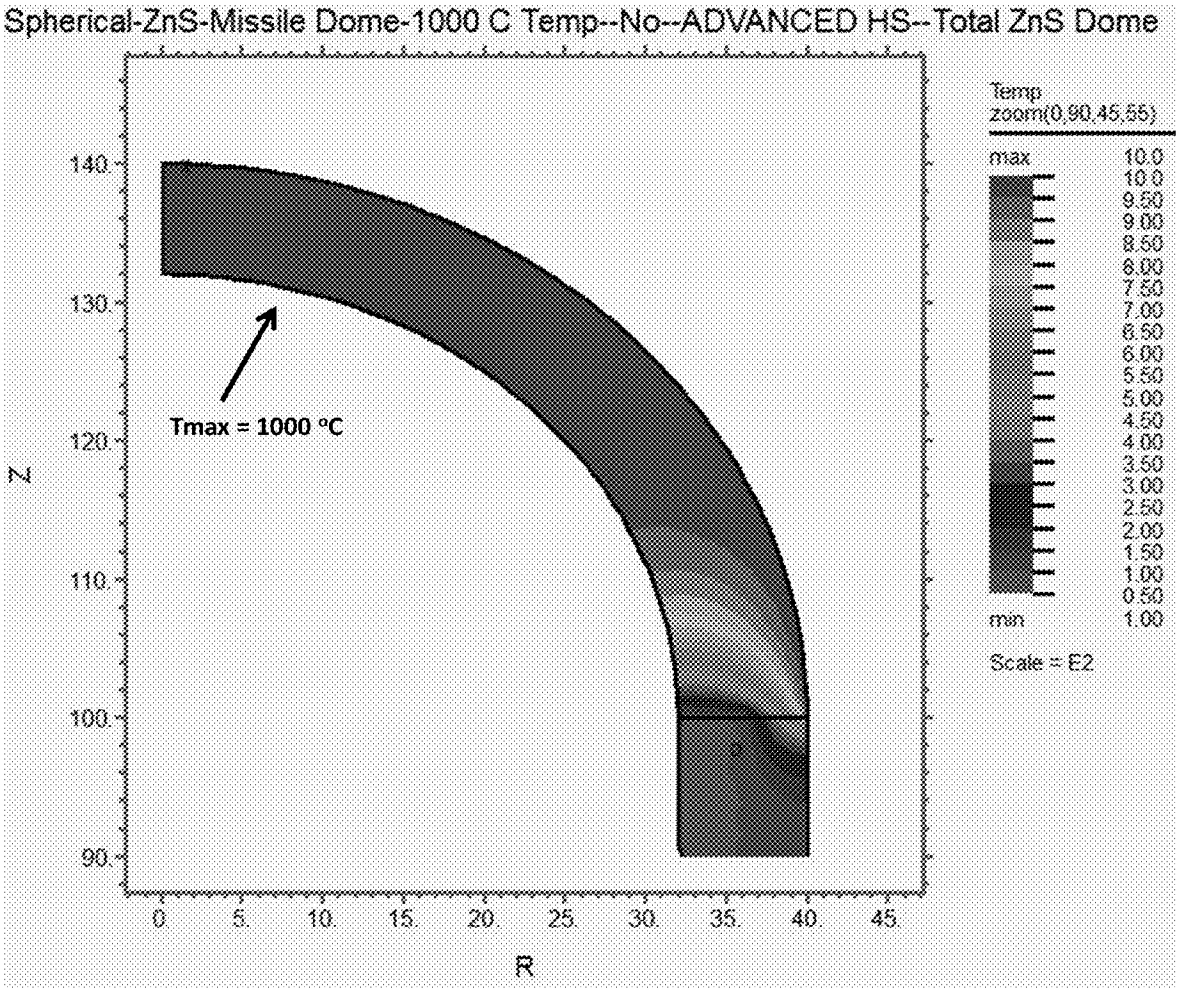
FIG. 16. Dome temperature profile plus part of cylindrical casing, 8 mm thick ZnS dome and no advanced heat spreader cooling the inside surface of the missile dome. Outer top surface of dome heated to 1000° C. (or 1273 K) at Mach 3-6.
Figure 17:
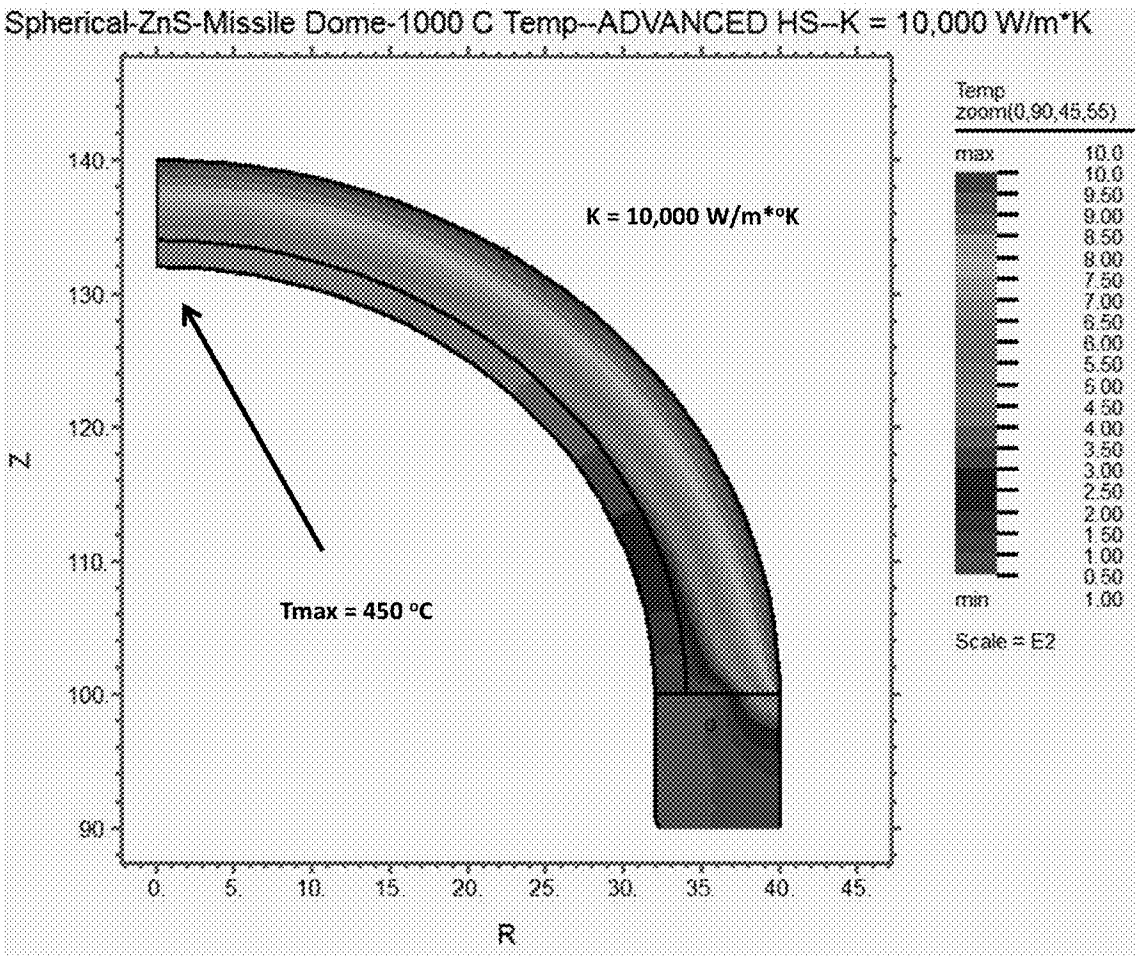
FIG. 17. Dome temperature profile with 2 mm thick Advanced Heat Spreader, 6 mm thick ZnS dome & heat exchanger cooled internally to 100° C. Outer top surface of dome heated to 1000° C. at Mach 3-6.
Figure 18:
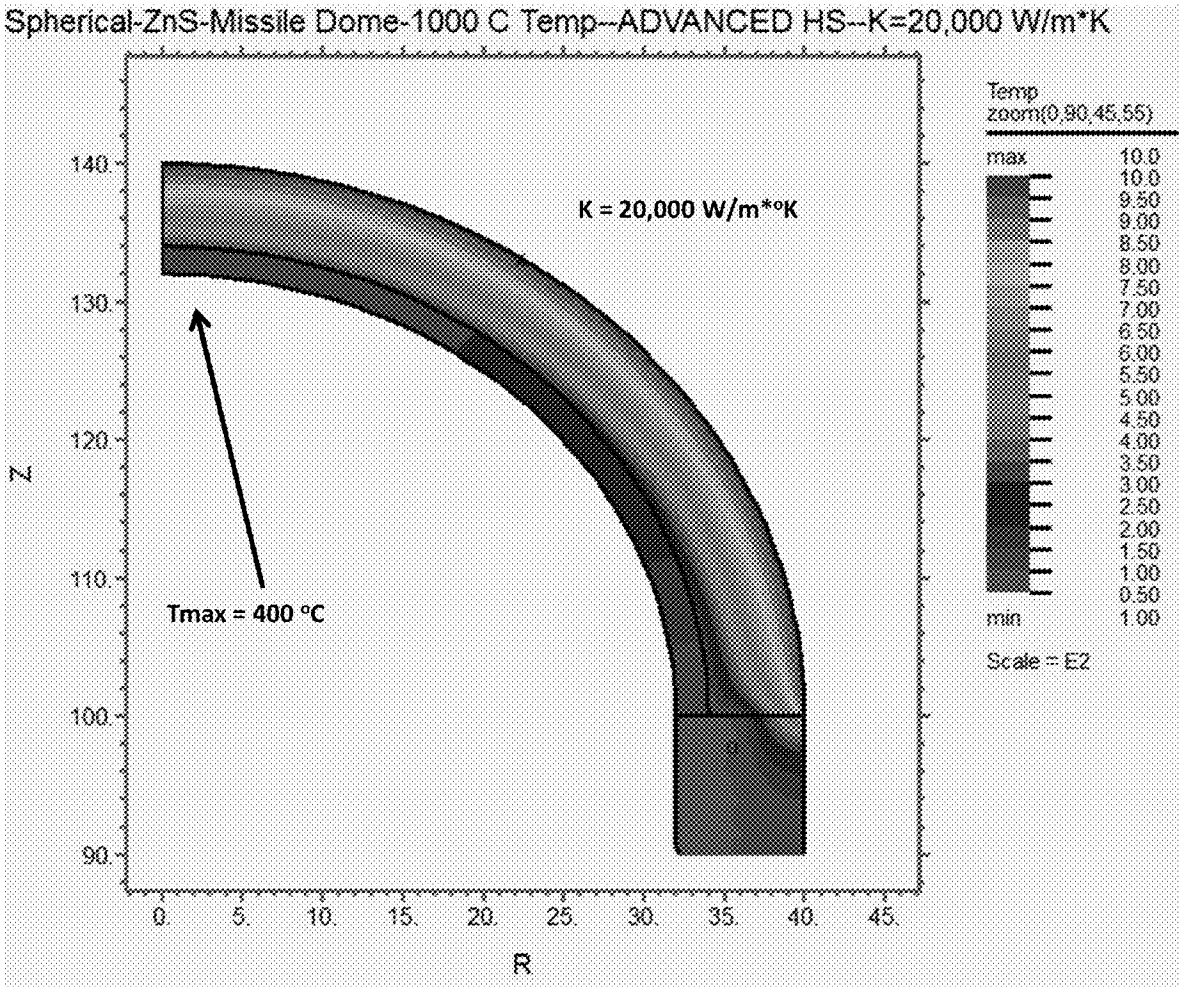
FIG. 18. Dome temperature profile plus part of cylindrical casing, 6 mm thick ZnS dome & heat exchanger 2 mm thick advanced heat spreader cooled internally to 100° C. Outer top surface of dome heated to 1000° C. (or 1273° K) at Mach 3-6. AHS has effective thermal conductivity of 20,000 W/m*K.
Figure 19:
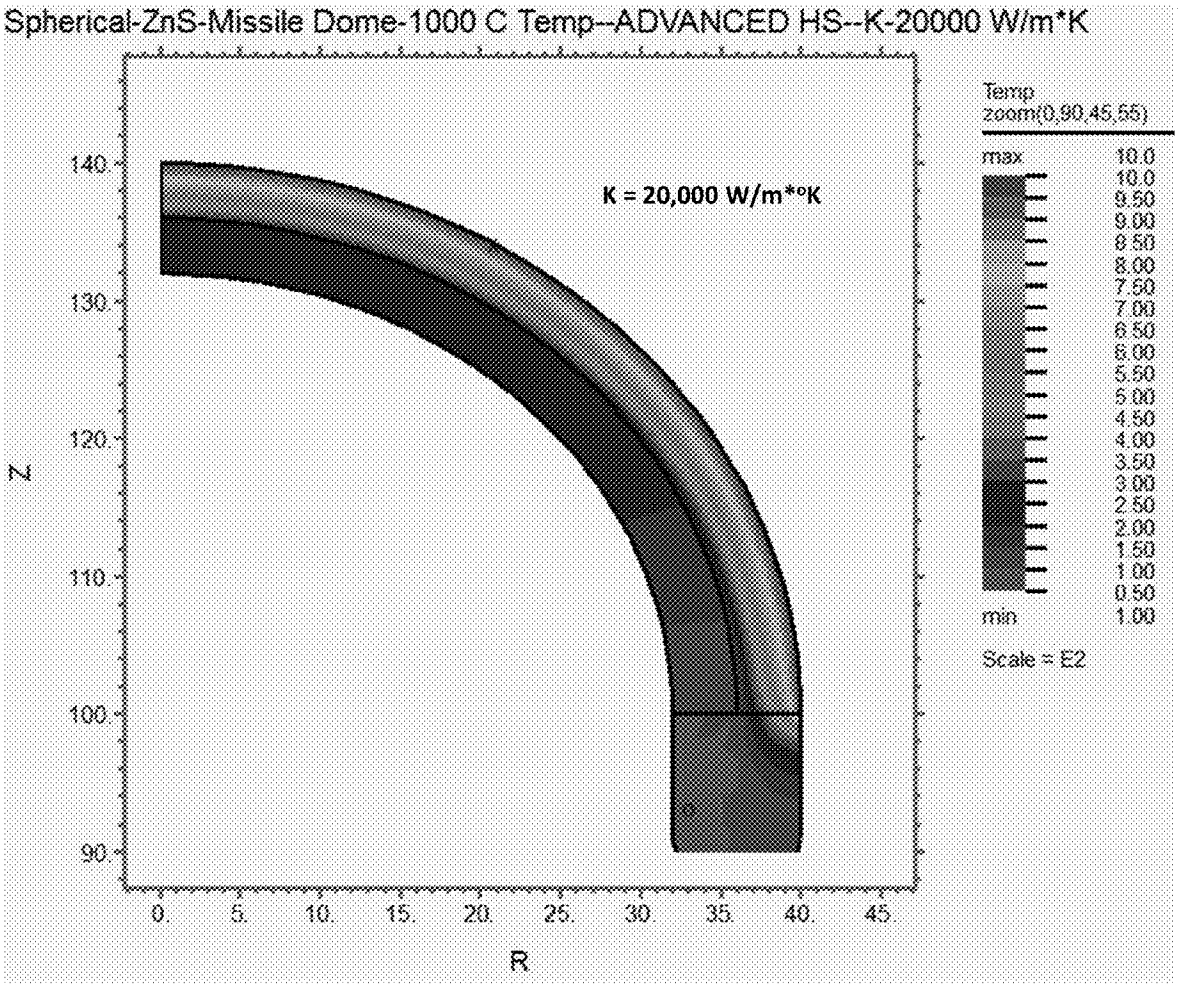
FIG. 19. Dome temperature profile with 4 mm thick Advanced Heat Spreader, 4 mm thick ZnS dome with heat exchanger cooling internally the outer 4 mm missile dome to 100° C. Outer top surface of dome heated to 1000° C. at Mach 3-6. AHS has effective thermal conductivity of 20,000 W/m*K.

FIG. 14 shows two types of missiles, one having a conformal optic and the other being a more conventional spherical dome. The advantages of the former are the longer range and there is a reduction in air friction which reduces the dome temperature. The present invention focuses on using the oscillating heat pipe with the spherical window domes of the missiles. The overall intent this proposal is to design, fabricate and integrate active cooling-heat spreader on the back surface of a missile dome or window. As related above, this active cooling approach uses oscillating heat pipes (OHP) that have demonstrated an effective thermal conductivities of 10-20,000 W/m·K. In addition, the active cooling component can be fabricated from same materials as the dome, thereby matching the coefficient of thermal expansion (CTE) and thus significantly reducing transient and/or near-equilibrium stress in the dome created by the thermal gradients during their travel at Mach 3-6. Another operating feature is these closed-loop OHP's perform better as the thermal heat density increases as shown in FIG. 7 resulting in heat removal fluxes greater than $kW/cm^2$ from the back surface of the missile dome.

The method of making such a "heat spreader" is to use a "mechanically-controlled, two-phase heat pipe as shown in FIG. 14. The method of integrating this mechanically controlled OHP to the missile dome or radome is depicted in FIGS. 1*b*, 2*b*, 3, and 4. The properties of this high performance system are listed in part below.

Specific Design of Oscillating Heat Pipe for Dome Window

Figure 12:
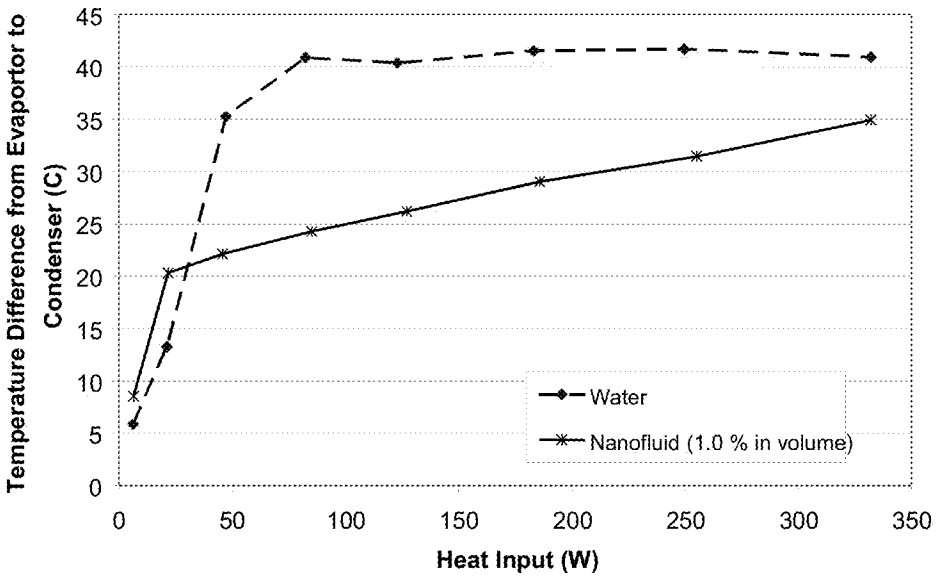
FIG. 12. Nanofluid Effect on the Heat Transport Capability in an Oscillating Heat Pipe (Filled Ratio=50%, Nanoparticles: Diamond, 5-50 nm, 1.0% in volume).
Figure 13:
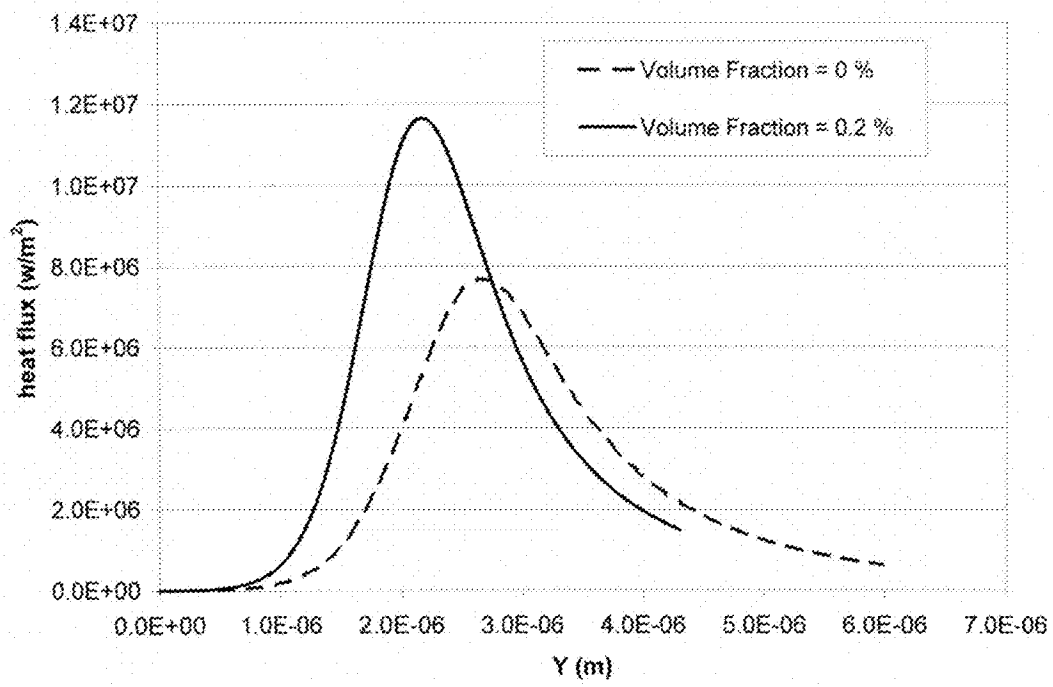
FIG. 13. Nano-particle effect on thin film evaporation.
Figure 27:
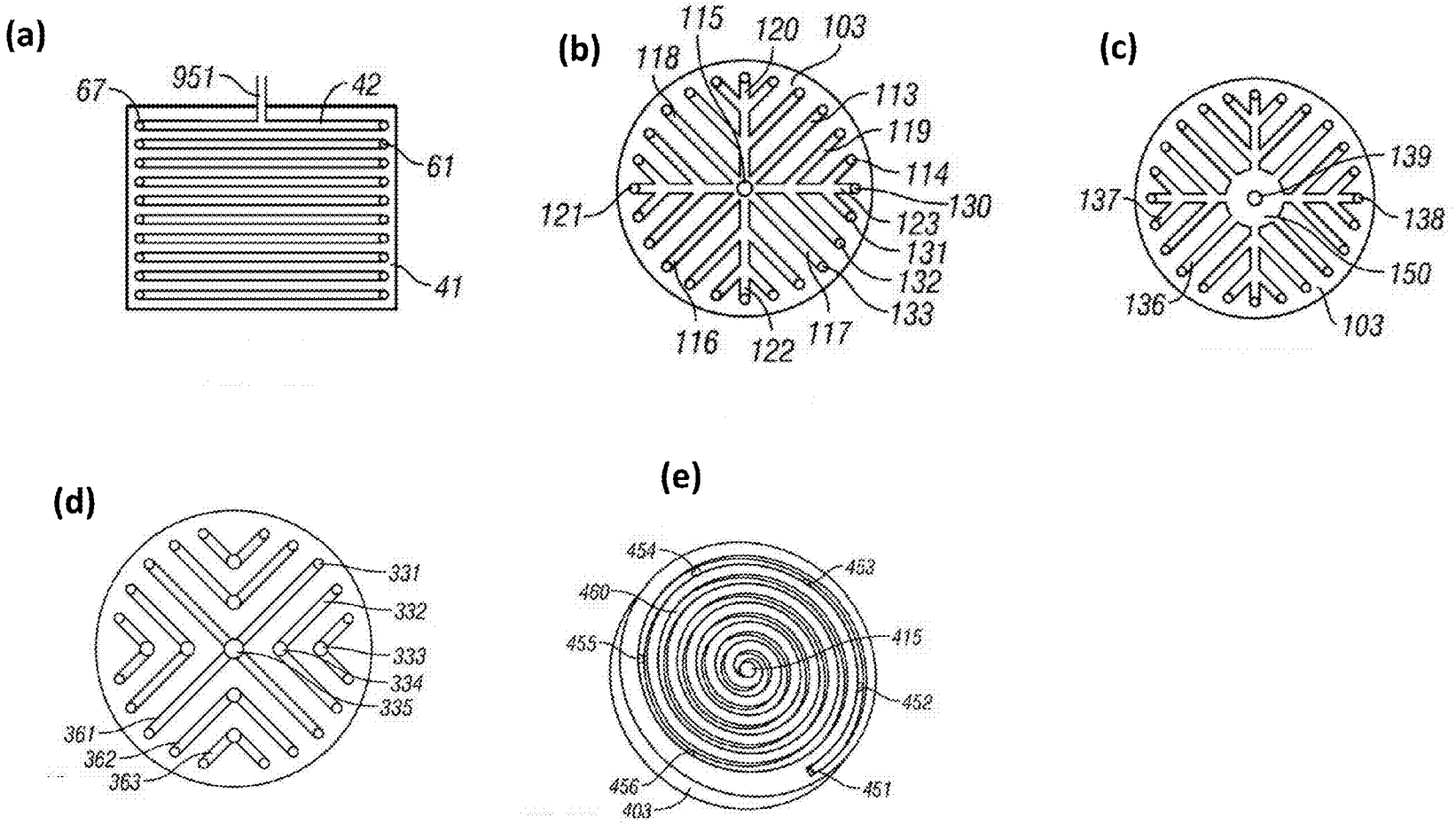
FIG. 27. Various groove designs and configuration for OHP geometry for missile cone cooling.

Based on investigations of a suitable OHP design for back surface of window dome, various prototypes similar to those shown in FIG. 27 for various OHP channel paths are found to be the most attractive. The details of each of these approaches will be discussed below. However, now the other important aspects of the invention are highlighted. FIG. 27*a-e* show oscillating heat pipe spreaders embedded with an interconnected closed loop, which are preferably fabricated from one plate with one layer (i.e., on one surface). These various configurations illustrate a heat spreader embedded with two interconnected closed loops, but each of these loops are preferably arranged in two layers, and the channels between two layers for each interconnected closed loop are interconnected. The hydraulic diameter of the channel ranges from 100 μm to 1500 μm. The final dimension depends on mathematical modeling and experimental investigation. Typically, the advanced heat spreader will have a size ranging from 5 cm×5 cm to 20 cm×20 cm depending on the total power input and heat flux level. The heat spreader thickness ranges from 1 mm to 5 mm depending also on the power input and heat flux level. The materials used for the AHS-OHP are IR transmitting materials like ZnS, ZnSe, and $CaF_2$ with good transmission in the infrared wavelength region. The "working fluid" to be used is preferably FC-72 and FC-75 mixed with nanoparticles to enhance its heat transfer property similar to data reported in FIGS. 12-13. [H. Yoshida, et. al., "Heavy fluorocarbon liquids for a phase-conjugaged stimulated Brillouin scattering mirror", Applied Optics, Vol. 36, p. 3740 (1997)].

Aerodynamic Cooling "Source" within the Missile Structure

Figure 25:
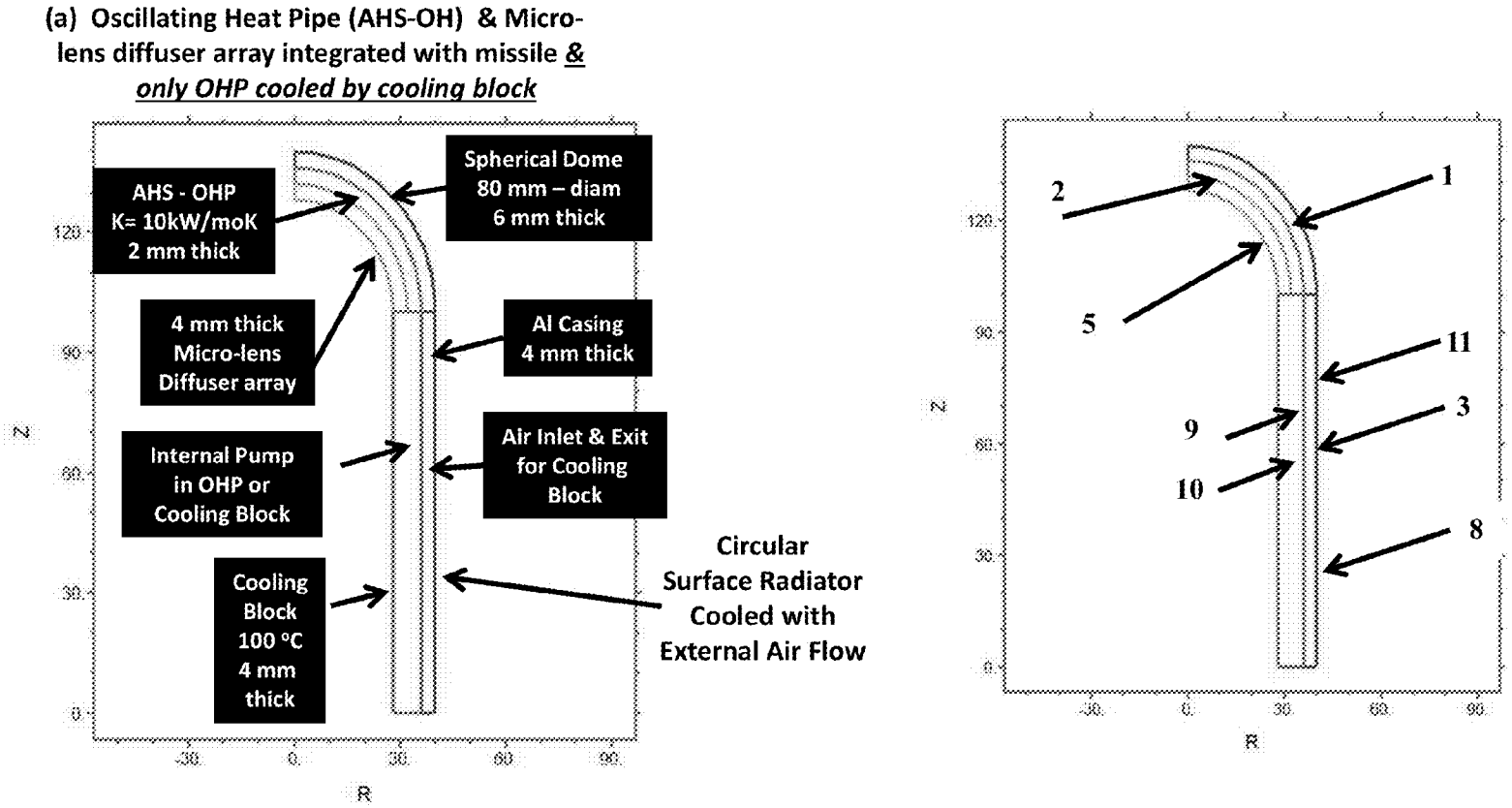
FIG. 25. Oscillating Heat Pipe (AHS-OHP) and Microlens diffuser array integrated with missile and only OHP cooled by cooling block.

To remove the thermal heat transferred from the hot window dome or radome, made of materials like ceramics, silicon carbide, fused silica and other refractory materials, the "output end" of the forced convective, oscillating heat pipe is preferably connected to an internal pump and then to surface radiators on or inside the outer side casing as FIGS. 24-26 illustrate. The high flow of atmospheric air through these surface radiators existing around the circumference of the missile provide the aerodynamic cooling "within" the missile structure.

Optical-Diffractive Effects in IR Seeking Missiles

Other important issues for the OHP thermal cooling include: Image quality while viewing through added complex layer of varied optical materials; how the cooler assembly affects the blur circle; diffraction effects due to structure of the cooling tubes; and how the inevitable index-of-refraction mis-match all of the component materials across the MWIR or LSIR wavelength band affects chromatic aberration control and line-of-site pointing errors.

Figure 21:
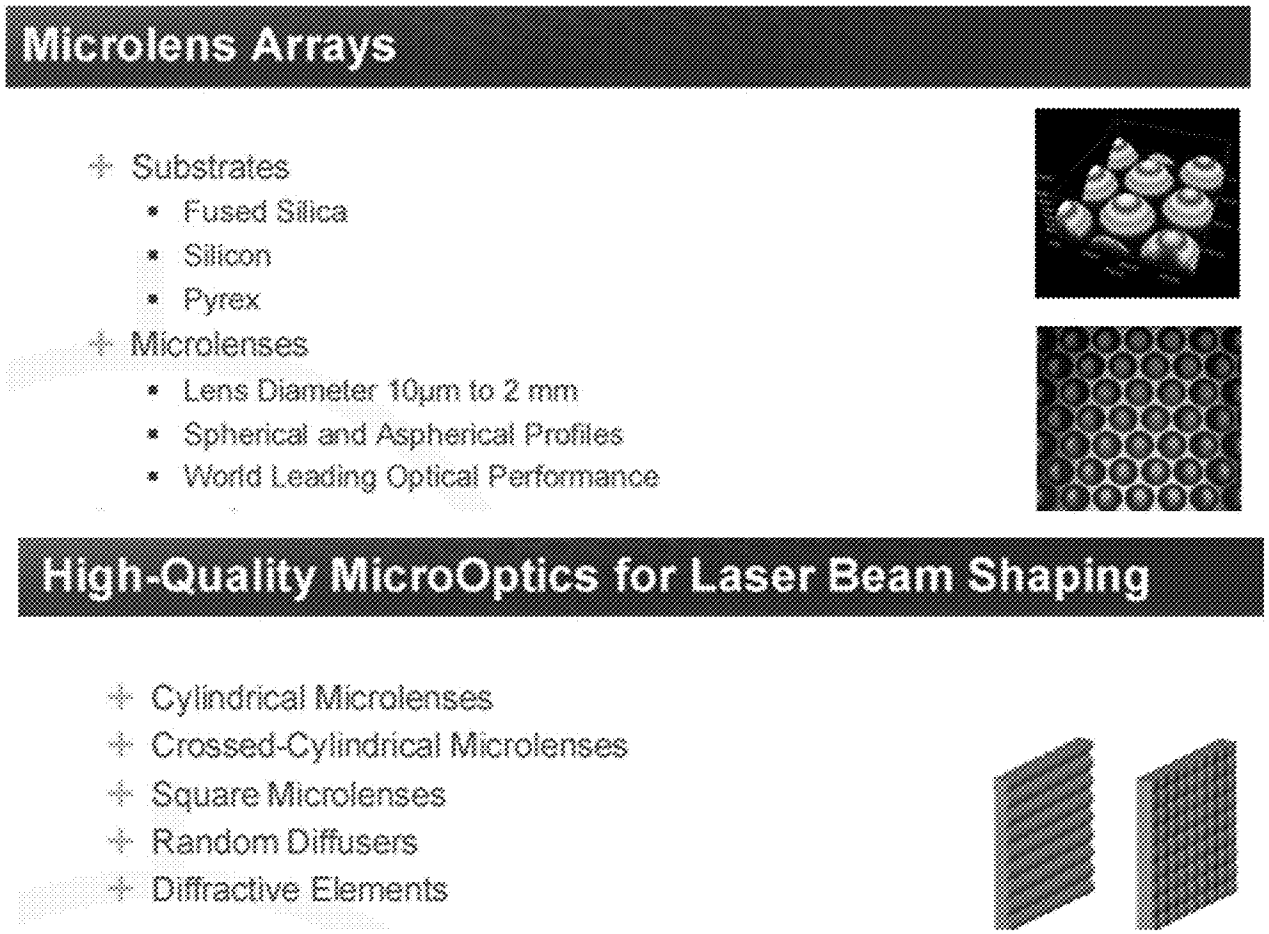
FIG. 21. Various microlens arrays which can be employed for incoherent and coherent laser beam shaping and homogenization beam output.
Figure 22A:
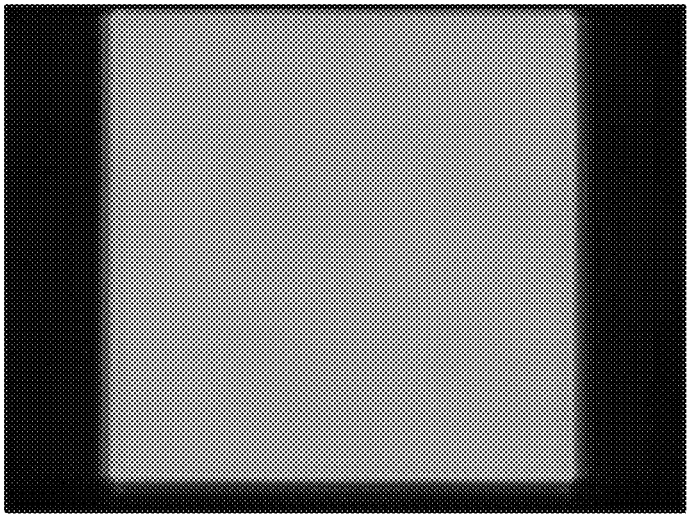
FIG. 22A illustrates 2-D square homogenized beams from a typical microlens system.
Figure 22B:
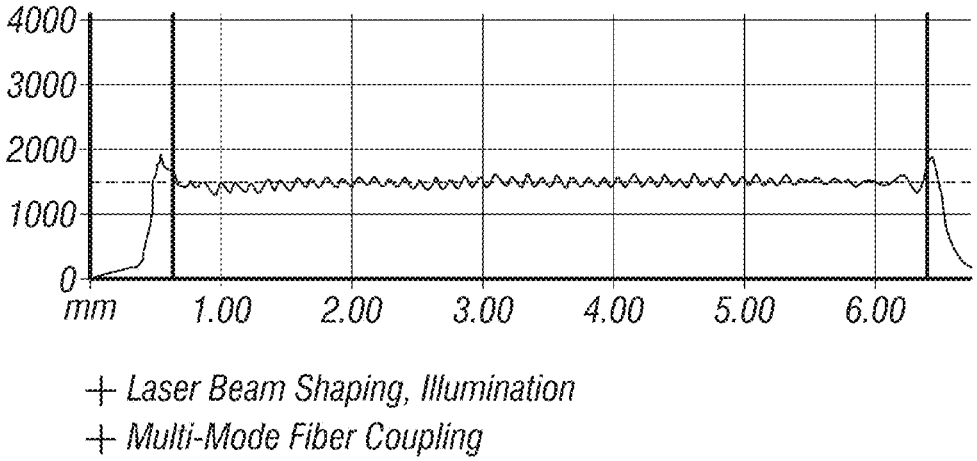
FIG. 22B illustrates a "sliced" scan of homogenized beam showing nearly flat-top uniformity created by the microlens system.
Figure 22C:
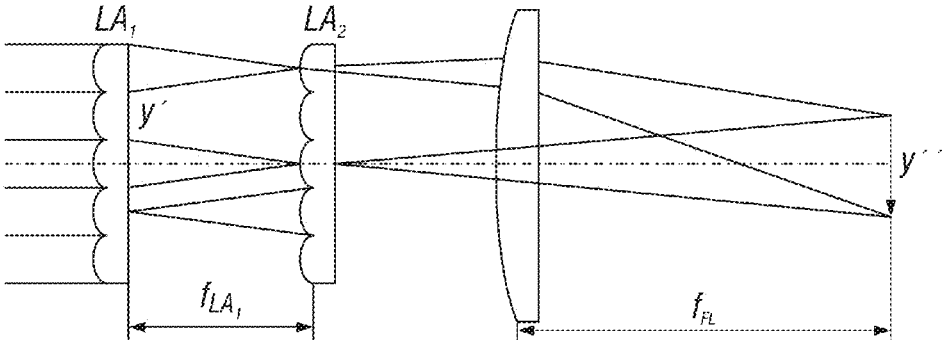
FIG. 22C is an optical configuration of a typical fly's eye imaging condensor system consisting of lens arrays $LA_1$ and $LA_2$ focusing lens of $f_{FL}$, and focusing length and imaging width y".
Figure 22D:
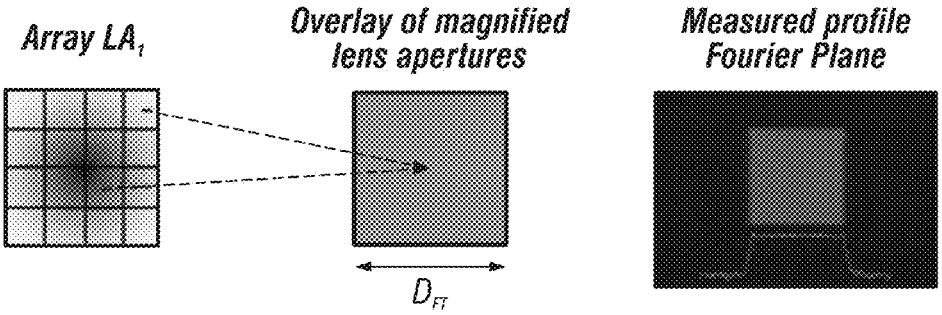
FIG. 22D illustrates a sequence of microlens homogenization systems consisting of microlens arrays, condensor and focusing lens.

All of the these effects are expected to be greatly negated by integrating a nose cone similarly shaped, micro-lens diffuser system to the back side of the oscillating heat pipe (OHP)—IR or RF missile nose cone which has hemispheric, minimal aerodynamic drag and/or conformal designs. The diverse and extensive highlights of these micro-lens diffuser systems were described above for FIGS. 21-22.

Referring to FIGS. 24*a* and *b*, the integrated thermal management system for the active cooling of and IR or RF seeking missile is shown. Below the dome or radome is either a bonded AHS-OHP having the same shape as the specific missile nose cone or a monolithic AHS-OHP-IR nosecone. Note in FIG. 24*a* that the nose cone is denoted as spherical here but it could be hemispherical, and alternately special minimized aerodynamic drag shape and/or conformal configuration. Other parts of this missile thermal management system are (a) "internal pump" placed either in OHP grooved structure and/or the "cooling-block" or between them, (b) air inlet and exit for cooling block and (c) "circular surface radiator cooled with external air flow". The "circular surface radiator cooled with external air flow" and the "cooling block" are one in the same but labeled separately since the $1^{st}$ name implies it is outside of Al casing and $2^{nd}$ name denotes it is inside of Al casing. Other casings than Al casing can be used but it is referred to as "Al casing" in this figure. In FIG. 24*b*, the 1 is either the present IR or RF missile nose cone, 2 is the oscillating heat pipe having one of these possible groove configurations shown in FIG. 27 described below. Other components of this missile advanced thermal management system are: 9—internal pump for forced convective flow of "working fluid" of the OHP; 4—"cooling block" providing in this figure 100° C. temperature heat exchanger control via aerodynamic flow of external air through its radiator design; 11—slotted inlet for inlet of aerodynamic cooling of the "cooling block"/"circular surface radiator cooled with external air flow"; 3—missile casing denoted in FIG. 24*a* as "Al casing" but can be any low weight material; and 8—slotted outlet for inlet of aerodynamic cooling of the "cooling block"/"circular surface radiator cooled with external air flow".

Figure 8:
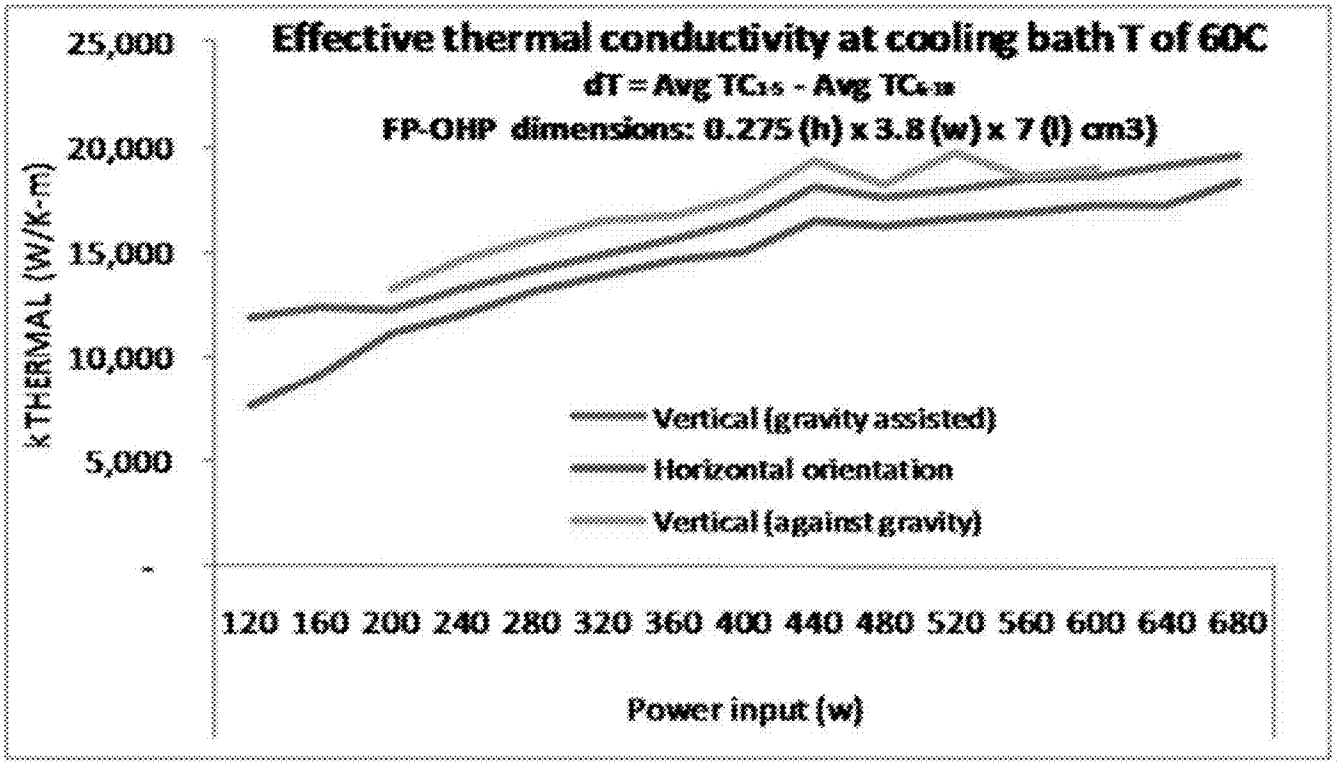
FIG. 8. "Effective" thermal conductivity of 3D-FP-OHP. FP—flat plate.
Figure 10:
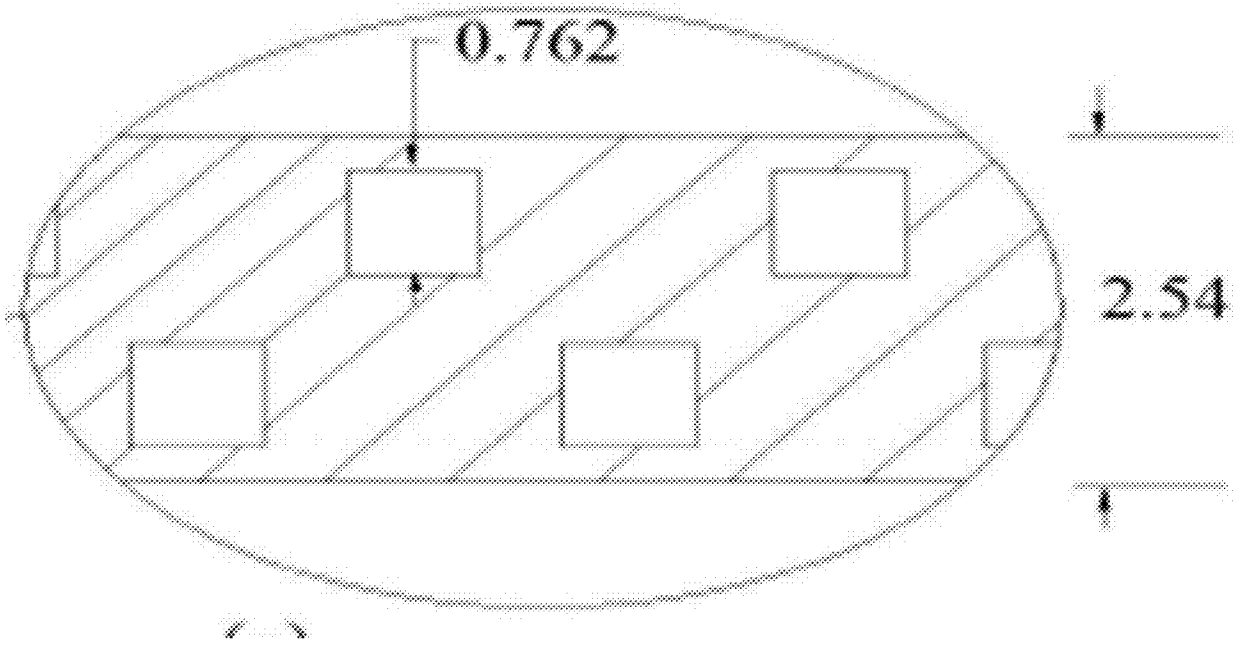
FIG. 10. Cross Section illustrating "Evaporating" (top) & "Condensating" (lower) in grooves of FP-OHP—FIG. 8.

The operation of this first embodiment of the invention is now described. During the missile's initial flight, several actions occur, namely, (a) inlet air 11 immediately begins to cool the "cooling block" 4 toward a designed temperature (100° C. in this discussion) and, (b) internal pump 9 forces "working fluid" though the grooved OHP, (c) the IR dome of RF radome 1 begins to be aerodynamically heated, and the "working fluid" is simultaneously heated forming the "bubble-plug" spatial oscillating movement due to the "working fluid" vaporization as described before in FIGS. 5-10. As the nose cone surface further heats, the vaporization rate increases and higher effective thermal conductivity occurs in the OHP, a condition similar to that shown in FIG. 8. The enhanced flow of the "working fluid" by the internal pump 9 provide faster flow through the flow channels (not shown) in the "cooling block" 4 removing heat and then this "working fluid" returns to the OHP via other flow channels (also not shown) similar to those existing in the various OHP configurations in FIG. 27.

FIG. 27 shows the top view of various configurations for high heat thermal heat transfer using OHP integrated with back surface of IR or RF missiles. Each one of these designs are made into either hemispherical, aerodynamic minimized drag shape or spherical geometrical configurations compatible for being either bonded to backside of missile nose cone or monolithically cast molded together. The outer edges of design would be a the outer edges of the nose cone and the central region of top view shown in FIG. 27*a-e* would be at the tip of the nose cone. In FIG. 27*a* is a linear groove design where grooves like 42 conduct heat via OHP action from the nose cone to the circular "cooling block" 4 via the OHP backside exit port 41 located at bottom edge of the IR or RF nose cone 1. 61 and 67 and the entrance ports to the OHP at bottom edge of the nose cone coming from ducting (not shown) from the "cooling block" 4. 951 is the evacuating/filling port for filling closed cycle OHP with "working fluid". It is sealed off (i.e., closed) after the filling.

FIG. 27*b* is a circular, "spoke" groove design where the "working fluid" returns from the "block cooler" 4 and enters through port 115, flows through groves 118, 120, 113, 119, 123, 117, and 116 and exits at outside bottom of nose cone via all the ports 114, 130, 131-133, and 121. FIG. 27*c* is similar OHP design configuration to FIG. 27*b* with a smaller number of grooves returning the "working down into the "block cooler". Here the "working fluid" returns from the "block cooler" 4 and enters through port 139, flows through grooves 136 and 137 and exits at outside bottom of nose cone via ports like 138 going to the "block cooler" 4. 150 is the region at top of OHP nose cone where "working fluid" returns from the "block cooler" 4. FIG. 27*d* is another "spoke, circular design with return of "working fluid" through ports 333-335, at top of nose cone below the IR dome or RF radome. The "working fluid" flows through grooves 332, 361-363 and exits through ports like 331 going to the "block cooler" 4. Finally, FIG. 27*e* is a single spiral design where "working fluid" enter OHP from returning "block cooler" 4 through port 415 and flows through grooves 460, 456, 453 and then exits through ports 452, 451, 455 and 454 going into "block cooler" 4. Label 403 is the outer bottom edge of OHP bonded to the missile nose cone.

Second Embodiment

Figure 23A:
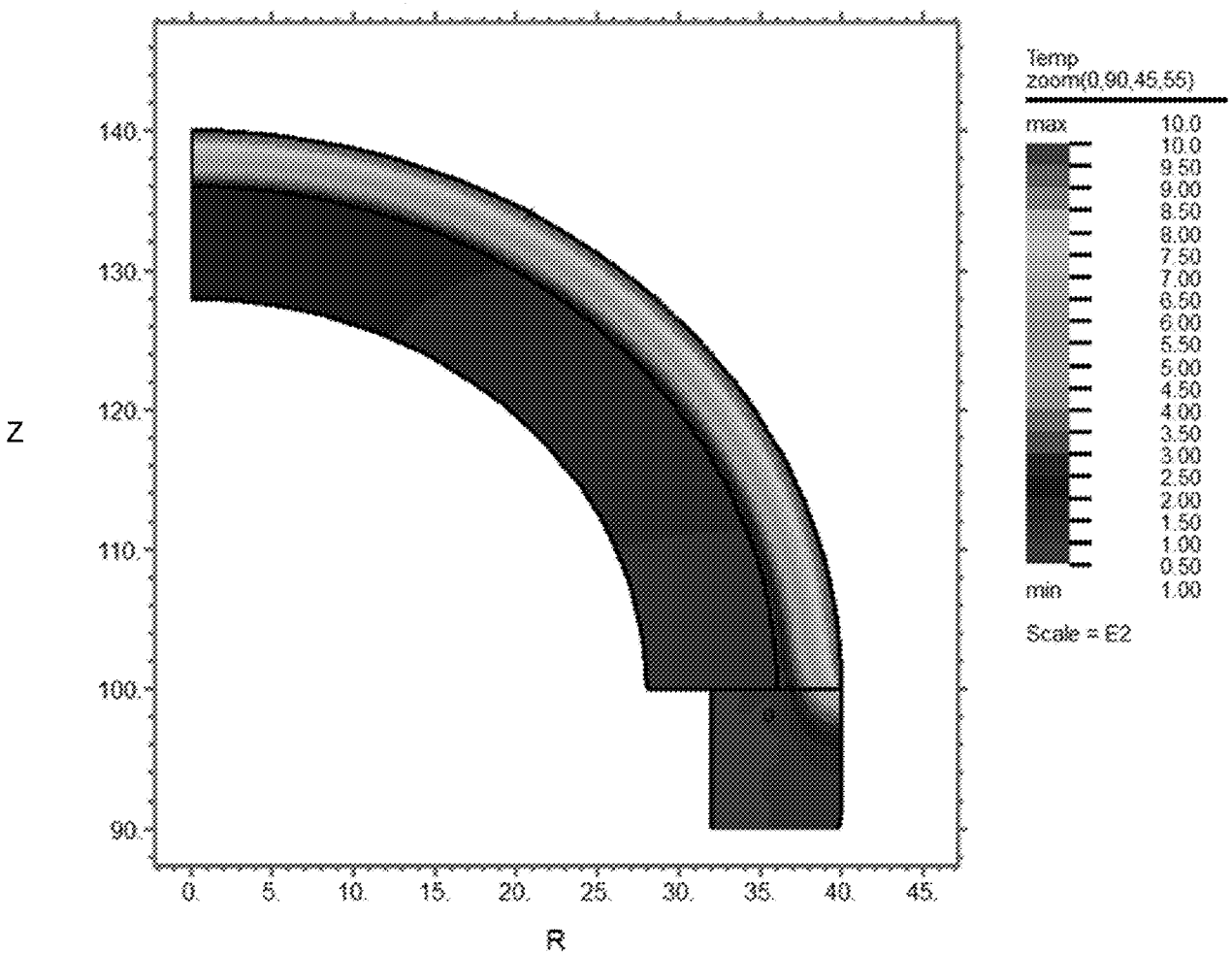
FIG. 23A illustrates the OHP and micro-lens diffuser array integrated with the Pseudo-Missile, with only the OHP cooled by the "block cooler" at 100° C.

This embodiment is an expansion of the first embodiment but it will significantly improve the acquisition of good view quality for the missile. The various configurations of grooves, entrance and exit ports of the flowing "working fluid", the different refractive indices of the optical materials and "working fluids" and the temperature variations of the refractive indices of the different materials can create various diffractive effects. To overcome this potential unwanted behavior, a micro-lens diffuser array system referred to as in this case "4 mm thick Micro-lens Diffuser array" in FIG. 25*a* which is conformal to the backside of the OHP thermal management system is introduced as shown. For the IR missiles, this diffuser array 5 homogenizes the radiation propagating through the optical window and OHP and thereby minimizing any diffractive effects which would produce poor imaging view. In addition, this embodiment has direct contact with the "block cooler" which may allow it to be separated from the OHP to allow improved view imaging of the monitored IR radiation. FIG. 23*a* shows resulting temperature behavior.

Third Embodiment

Figure 23B:
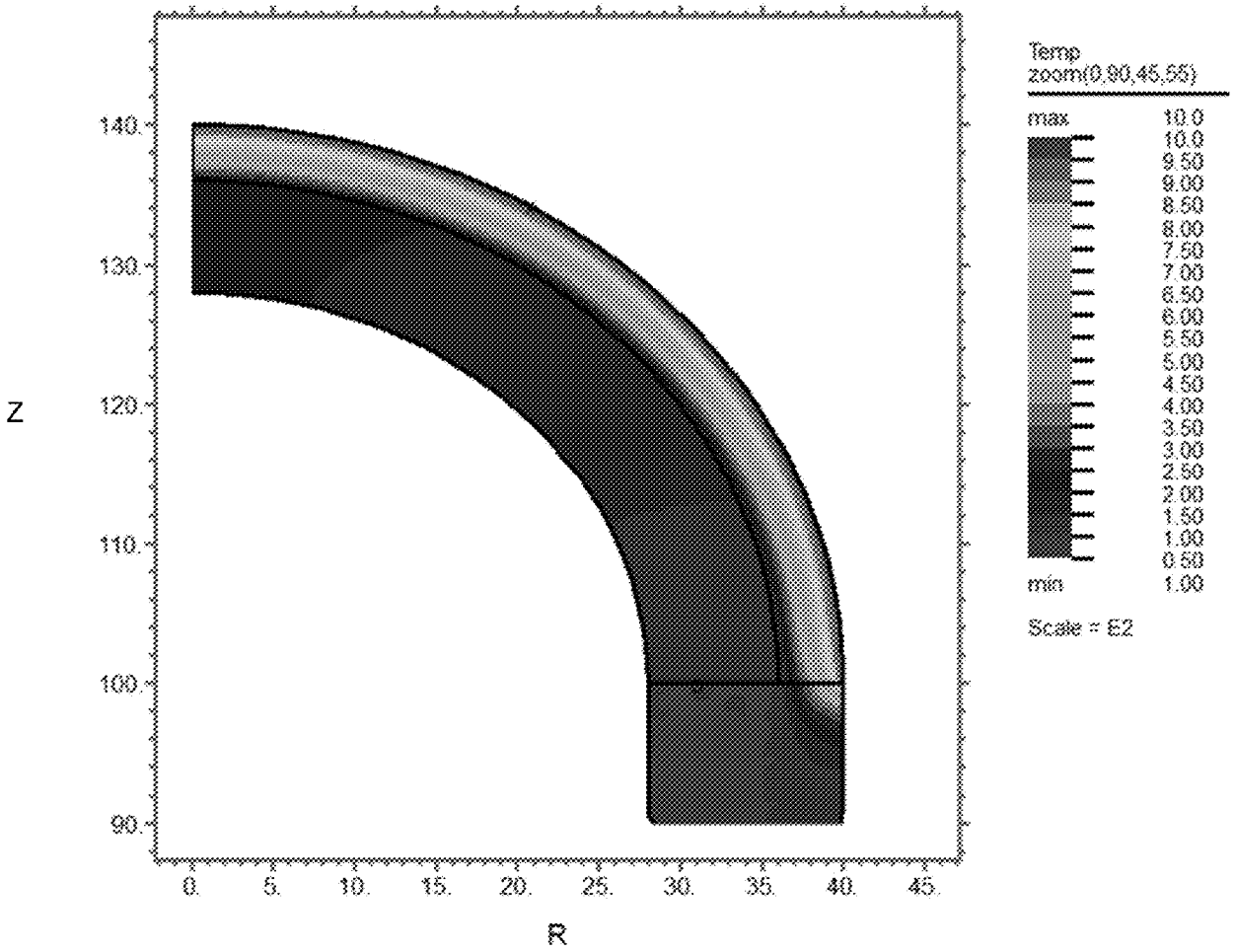
FIG. 23B illustrates the OHP and micro-lens diffuser array integrated with the Pseudo-Missile and both the OHP and micro-lens diffuser array cooled by the "block cooler" at 100° C. See also FIGS. 24-26.

This embodiment is similar to the second embodiment but in this embodiment, the micro-lens diffuser array does not have direct contact with the "block cooler" which may allow it to be separated from the OHP to allow improved view imaging of the monitored IR radiation. FIG. 23*b* shows the resulting temperature behavior which has negligible difference with the thermal analysis results of FIG. 23*a*. Again like the second embodiment, this an expansion of the first embodiment and it will significantly improve the acquisition of good view quality for the missile. The various configurations of grooves, entrance and exit ports of the flowing "working fluid", the different refractive indices of the optical materials and "working fluids" and the temperature variations of the refractive indices of the different materials can create various diffractive effects. To overcome this potential unwanted behavior, a micro-lens diffuser array system referred to as in this case "4 mm thick Micro-lens Diffuser array" in FIG. 25*a* which is conformal to the backside of the OHP thermal management system and get be separated by air from the backside of the OHP as shown. For the IR missiles, this diffuser array 5 homogenizes the radiation propagating through the optical window and OHP and thereby minimizing any diffractive effects which would produce poor imaging view.

Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A thermal management system for active cooling of high speed seeker missile domes or radomes comprising:

a heat pipe system having effective thermal conductivity of 10-20,000 W/m*K and comprising one or more mechanically controlled oscillating heat pipes;

an IR dome or RF radome bonded to said one or more mechanically controlled oscillating heat pipes; and supporting integrating structure including a surface bonded to the IR dome or RF radome that matches the coefficient of thermal expansion of the dome or radome material and that of said one or more mechanically controlled oscillating heat pipes.

2. The system of claim 1 additionally comprising a pump to convectively move working fluid through said heat pipe system.

3. The system of claim 2 wherein the working fluid absorbs a pre-identified electromagnetic frequency to enhance performance of the dome or radome.

4. The system of claim 2 wherein the working fluid comprises a nanofluid.

5. The system of claim 4 wherein the working fluid comprises a diamond nanofluid.

6. The system of claim 1 additionally comprising a selective IR filter of a pre-identified wavelength of blackbody for missile operations.

7. The system of claim 1 wherein in operation said system reduces transient thermal optical performance conditions for the IR dome or RF radome.

8. The system of claim 1 additionally comprising an optical material having thermal K>=10,000 W/m*K applied to the dome or radome.

9. The system of claim 1 additionally comprising an ablative thin film to remove thermal heat.

10. The system of claim 1 additionally comprising one or more micro-lenses for a diffuser of IR or RF radiation to minimize diffractive effects arising from structural configuration of said heat pipe system on a back side of the dome or radome transmissive material.

11. A thermal management method for active cooling of high speed seeker missile domes or radomes comprising:

bonding to an IR dome or RF radome a heat pipe system having effective thermal conductivity of 10-20,000 W/m*K and comprising one or more mechanically controlled oscillating heat pipes;

employing supporting integrating structure including a surface bonded to the IR dome or RF radome that matches the coefficient of thermal expansion of the dome or radome material and that of said one or more mechanically controlled oscillating heat pipes; and operating the heat pipe system to cool the IR dome or RF radome while the missile is in flight.

12. The method of claim 11 additionally comprising pumping to convectively move working fluid through the heat pipe system.

13. The method of claim 12 wherein the working fluid absorbs a pre-identified electromagnetic frequency to enhance performance of the dome or radome.

14. The method of claim 12 wherein the working fluid comprises a nanofluid.

15. The method of claim 14 wherein the working fluid comprises a diamond nanofluid.

16. The method of claim 11 additionally comprising employing a selective IR filter of a pre-identified wavelength of blackbody for missile operations.

17. The method of claim 11 wherein the method reduces transient thermal optical performance conditions for the IR dome or RF radome.

18. The method of claim 11 additionally comprising employing an optical material having thermal K>=10,000 W/m*K applied to the dome or radome.

19. The method of claim 11 additionally comprising employing an ablative thin film to remove thermal heat.

20. The method of claim 11 additionally comprising employing one or more micro-lenses for a diffuser of IR or RF radiation to minimize diffractive effects arising from structural configuration of the heat pipe system on a back side of the dome or radome transmissive material.

* * * * *